US011850652B2

(12) United States Patent
Elford

(10) Patent No.: US 11,850,652 B2
(45) Date of Patent: Dec. 26, 2023

(54) RADIAL INCREMENTAL FORMING

(71) Applicant: The Boeing Company, Chicago, IL (US)

(72) Inventor: Michael Charles Elford, St. Lucia (AU)

(73) Assignee: The Boeing Company, Chicago, IL (US)

( * ) Notice: Subject to any disclaimer, the term of this patent is extended or adjusted under 35 U.S.C. 154(b) by 230 days.

(21) Appl. No.: 17/478,183

(22) Filed: Sep. 17, 2021

(65) Prior Publication Data

US 2023/0089822 A1 Mar. 23, 2023

(51) Int. Cl.
*B21D 9/05* (2006.01)

(52) U.S. Cl.
CPC ..... *B21D 9/05* (2013.01)

(58) Field of Classification Search
CPC . B21D 9/05; B21D 9/15; B21D 15/00; B21D 31/005; B21D 22/04; B21D 22/025; B21D 22/12; B21D 22/14; B21D 22/16; B21D 22/18; B21D 22/185; B21D 22/105
See application file for complete search history.

(56) References Cited

U.S. PATENT DOCUMENTS

| | | | | |
|---|---|---|---|---|
| 5,363,308 | A | 11/1994 | Guyder | |
| 6,442,988 | B1 * | 9/2002 | Hamstra | B21D 22/16 72/379.4 |
| 8,997,541 | B2 * | 4/2015 | Nillies | B21C 37/26 72/85 |
| 2005/0257588 | A1 * | 11/2005 | Lancaster | B21D 22/16 72/84 |

FOREIGN PATENT DOCUMENTS

| | | | |
|---|---|---|---|
| WO | 2007030824 | A2 | 3/2007 |
| WO | 2011160109 | A1 | 12/2011 |
| WO | 2020227224 | A1 | 11/2020 |

* cited by examiner

*Primary Examiner* — Teresa M Ekiert
(74) *Attorney, Agent, or Firm* — Quinn IP Law

(57) ABSTRACT

A method of radial incremental forming a component having a component inner mold line (IML) includes providing a mandrel having geometry configured to mate with the IML. The method also includes inserting the mandrel into a tubular workpiece composed of a formable material, to thereby sleeve the workpiece over the mandrel. The method additionally includes mounting the workpiece sleeved over the mandrel onto a drive mechanism configured to rotate the mandrel and having a forming tool configured to shift relative to the workpiece. The method further includes regulating, according to provided toolpath instructions, the drive mechanism to rotate the workpiece sleeved over the mandrel in concert with shifting the forming tool relative to the workpiece to incrementally deform the workpiece therewith over the mandrel and thereby form the component. A tool system having an electronic controller may employ the subject method to radially incrementally form a component.

20 Claims, 19 Drawing Sheets

RADIAL INCREMENTAL FORMING

INTRODUCTION

The present disclosure relates to a system and a method for radial incremental forming of a component.

Forming is a process of fashioning parts and objects through mechanical deformation. During such a forming process, a workpiece is generally reshaped without adding or removing material, such that its mass remains unchanged. Forming operates via elastoplastic deformation, whereby the workpiece experiences both elastic and plastic strain. The plastic strains contribute to permanent changes in workpiece shape, while the elastic strain is experienced only when the workpiece is being loaded. Through the cumulative action of plastic strains, a part is physically shaped to achieve a component having a desired inner mold line (IML).

Forming is frequently used in metalworking to fashion parts and objects from appropriate metal workpieces or blanks. Forming processes may employ specialty equipment such as machine presses and dies to apply high loads thereby generating the plastic strain required to produce the requisite shape. The metalworking process may be a single stage operation, where every stroke of the equipment produces the desired form on the workpiece, or the process may occur through a series of steps or stages.

Many forming processes start with a sheet metal blank which is planar, i.e., flat, however such planar sheets are not ideal for producing parts which are tubular in shape. For example, deep drawing of a tall cylindrical shape is prone to splitting on the walls of the cylinder. Some forming processes exist which begin operation on a metal tube in lieu of a flat sheet. Such processes include flow forming and metal spinning. These processes, which are similar in nature, are generally limited to producing axisymmetric parts. Thus, a need exists for a process to produce non-axisymmetric tubular parts from metal (or other formable material) tubing.

SUMMARY

A method of radial incremental forming a component having a component inner mold line (IML) includes providing a mandrel having geometry configured to match the IML. The method also includes inserting the mandrel along an axis into a tubular workpiece from a formable material, to thereby sleeve the tubular workpiece over the mandrel. The method additionally includes mounting the tubular workpiece sleeved over the mandrel onto a drive mechanism configured to rotate the mandrel about the axis. The drive mechanism includes a forming tool, such as a stylus, configured to shift relative to the tubular workpiece and apply a forming force to the tubular workpiece. The method also includes providing toolpath instructions configured to regulate operation of the drive mechanism. The method further includes regulating, according to the toolpath instructions, the drive mechanism to rotate the tubular workpiece sleeved over the mandrel in concert with shifting the forming tool relative to the workpiece to incrementally deform the tubular workpiece therewith over the mandrel and thereby form the component.

Providing the mandrel may include constructing the mandrel from multiple individual sections. In such an embodiment, the method may additionally include removing the multiple individual sections of the mandrel from the formed component without disturbing the component IML. Such mandrel sections may include provisions for enabling retraction thereof.

Providing the mandrel may also include constructing the mandrel from a material configured to be dissolved in a fluid, such as water. For example, the dissolvable mandrel may be constructed from Aquacore™ or SOLCORE™ material. In such an embodiment, the method may additionally include dissolving the mandrel to remove the mandrel from the formed component without disturbing the component IML.

Alternatively, the mandrel material may be any combination of one or more of polymer, timber, fiber board, metal, fiberglass, carbon fiber reinforced plastic (CFRP).

The mandrel geometry, which matches the IML of the component geometry, may have an axisymmetric or non-axisymmetric shape.

The toolpath instructions may include a radial level toolpath and a lace toolpath. In such an embodiment, the method may further include applying to the tubular workpiece, via the forming tool, the radial level toolpath followed by the lace toolpath to thereby minimize localized springback (due to an oil canning phenomenon) of the tubular workpiece and achieve a desired component IML.

According to the method, shifting the forming tool may be accomplished in a radial and/or axial direction relative to the tubular workpiece in concert with a rotation of the mandrel.

The tubular workpiece material may be a formable metal, such as an aluminum alloy, mild steel, stainless steel, titanium, and titanium-based alloys, nickel-based alloys such as Inconel, copper, bronze, brass, tin, or the like. As a non-limiting example, the initial sheet metal tubing may be a 2024-0 aluminum alloy tube with a 1.0-inch outer diameter and a wall thickness of 0.049 inches. In alternative embodiments, the workpiece material may be non-metallic, such as carbon fiber, and a have different wall thickness and/or outer diameter.

The drive mechanism may be a multi-axis drive mechanism controlled via an electronic controller programmed with the toolpath instructions. Such a multi-axis drive mechanism may, for example, be a computer numerical control (CNC) 4-axis lathe, a 5-axis CNC machine, or a multi-axis robot. The toolpath instructions may specifically include a plurality or sets of coordinates. According to the method, each set of the subject coordinates may identify a mandrel rotation, an axial shift of the forming tool, and a radial shift of the forming tool at a predetermined time relative to commencement of the forming of the component. In such an embodiment, the method may further include regulating the drive mechanism, via the electronic controller, to form the component.

According to the method, providing the toolpath instructions may include providing a digital definition of a surface geometry defining the component IML. Providing the toolpath instructions may also include generating a tool offset surface geometry based on the component IML surface geometry and transforming, via inverse cylindrical mapping, the tool offset surface geometry from a first topological space into a second topological space. Providing the toolpath instructions may additionally include intersecting the tool offset surface geometry in the second topological space with a plurality of parallel planes defined in the second topological space, to thereby obtain a plurality of toolpath contours connected to form a toolpath in the second topological space. Providing the toolpath instructions may also include transforming, via cylindrical mapping, the toolpath from the second topological space to the first topological space. Providing the toolpath instructions may further include selecting a plurality of points spaced along the toolpath. In such an embodiment, each of the plurality of points may be defined by one of the sets of coordinates (defining the mandrel rotation, the axial shift of the forming tool, and the radial shift of the forming tool at the corresponding predetermined time). Each mandrel rotation, axial shift of the forming tool, and radial shift of the forming tool may be identified relative to a predefined reference point on the forming tool.

An additional embodiment of the present disclosure is a tool system for radial incremental forming a component having a component IML.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

Figure 1:
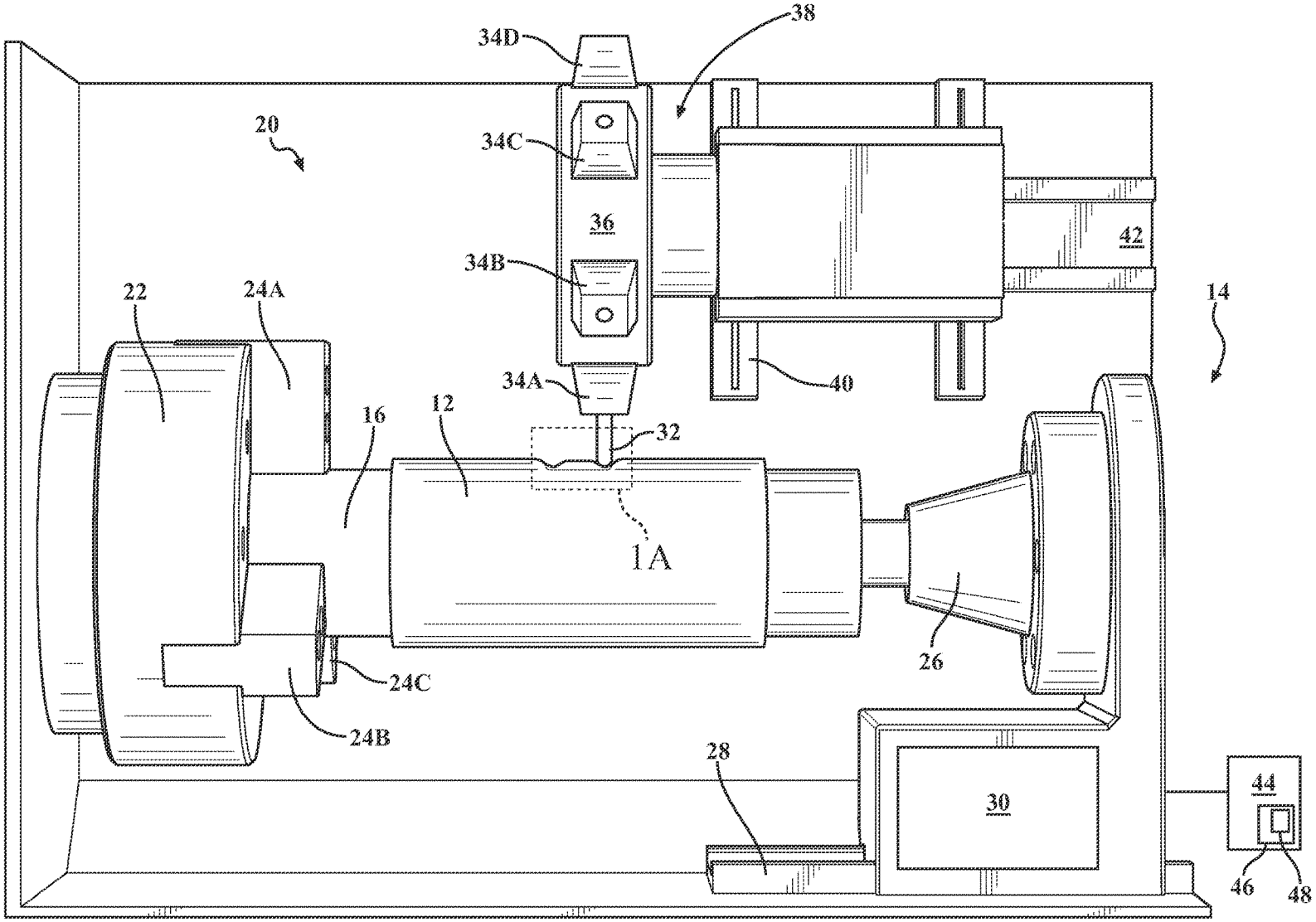
FIG. 1 is a schematic perspective illustration of an embodiment of a tool system having a rotational drive mechanism and a moveable forming (stylus) tool configured to manufacture the component shown in FIG. 1 from a tubular workpiece via radial incremental forming, according to the disclosure.

Embodiments of the present disclosure as described herein are intended to serve as examples. Other embodiments can take various and alternative forms. Additionally, the drawings are generally schematic and not necessarily to scale. Some features may be exaggerated or minimized to show details of particular components. Therefore, specific structural and functional details disclosed herein are not to be interpreted as limiting, but merely as a representative basis for teaching one skilled in the art to variously employ the present disclosure.

Certain terminology may be used in the following description for the purpose of reference only, and thus are not intended to be limiting. For example, terms such as "above" and "below" refer to directions in the drawings to which reference is made. Terms such as "front", "back", "fore", "aft", "left", "right", "rear", and "side" describe the orientation and/or location of portions of the components or elements within a consistent but arbitrary frame of reference, which is made clear by reference to the text and the associated drawings describing the components or elements under discussion. Moreover, terms such as "first", "second", "third", and so on may be used to describe separate components. Such terminology may include the words specifically mentioned above, derivatives thereof, and words of similar import.

Referring to the drawings in which like elements are identified with identical numerals throughout, FIGS. 1-13 illustrate manufacturing of a component 10 having an inner mold line (IML) 10A from a tube-shaped or tubular workpiece 12 (shown in FIGS. 4A and 4B in a cutaway form) having a longitudinal axis 15. The tubular workpiece 12 is generally a pre-cut piece of a tube, e.g., a pipe segment, made from a formable material. The tubular workpiece 12 may, for example, be composed of formable metal such as aluminum alloy, mild steel, stainless steel, titanium and titanium-based alloys, nickel-based alloys such as Inconel, copper, bronze, brass, tin, or the like. As a non-limiting example, the initial sheet metal tubing may be a 2024-0 aluminum alloy tube with a 1.0-inch outer diameter and a wall thickness of 0.049 inches. In alternative embodiments the workpiece material may be non-metallic, such as carbon fiber, and a have different wall thickness and/or outer diameter. The component IML 10A may have a non-axisymmetric shape, i.e., a shape which varies asymmetrically with respect to rotation about the axis 15 (shown in FIGS. 4A and 4B). Alternatively, the component contour 10A may have an axisymmetric shape, i.e., a shape which is symmetrical with respect to rotation about the axis 15 (not shown).

The system and method disclosed in detail below are specifically established to manufacture a component via radial incremental forming. As disclosed herein, radial incremental forming is capable of progressively deforming a tube-shaped or tubular workpiece, such as the workpiece 12, to generate therein various features and shapes, such as pockets and grooves. Moreover, while radial incremental forming may be used to generate axisymmetric shapes, i.e., having rotational symmetry with respect to a central axis, the process is particularly useful for generating non-axisymmetric features and shapes, i.e., where the component IMLs are devoid of rotational symmetry with respect to a central axis of the component.

Figure 1A:
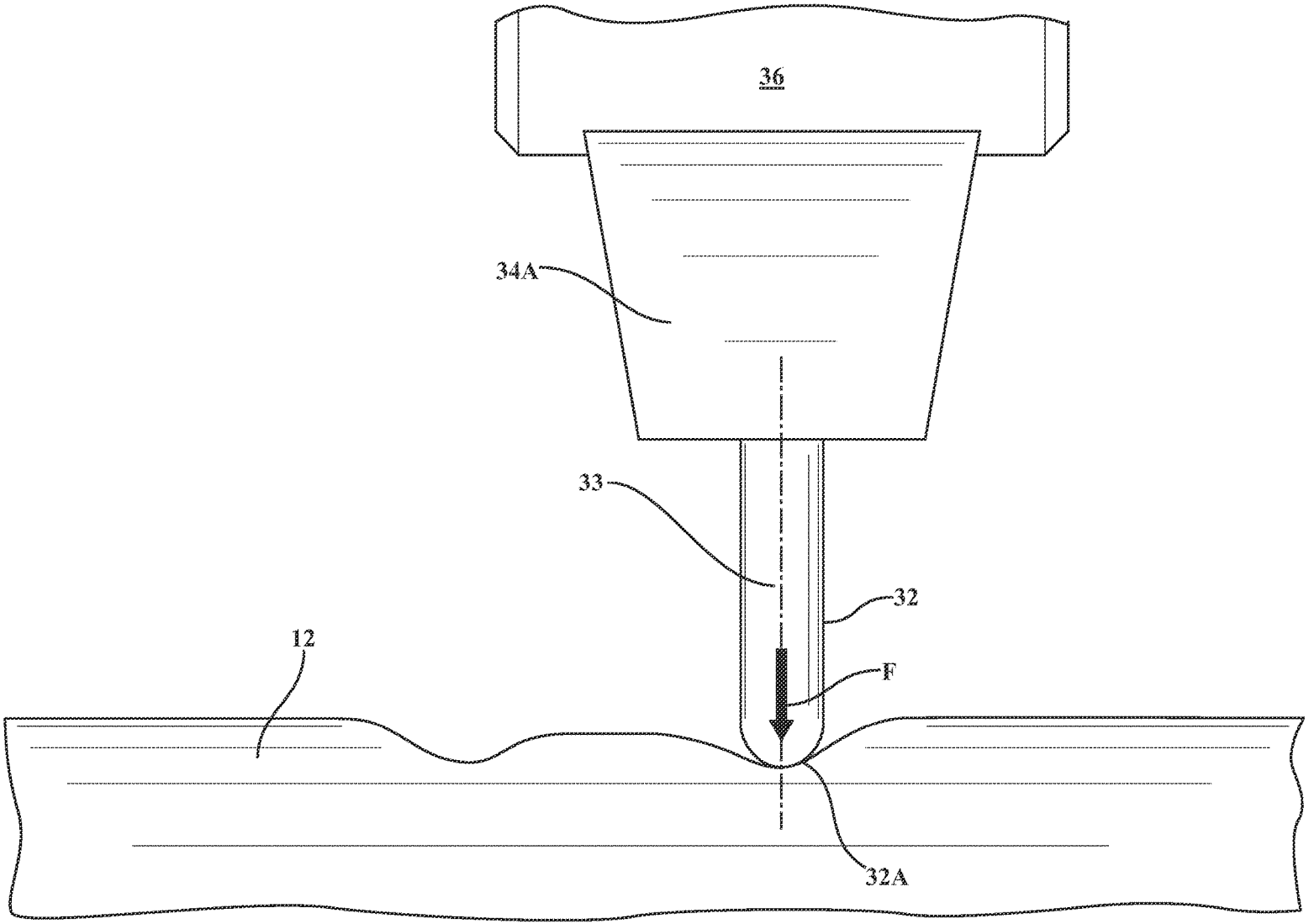
FIG. 1A is a close-up view of a portion of FIG. 1.
Figure 3A:
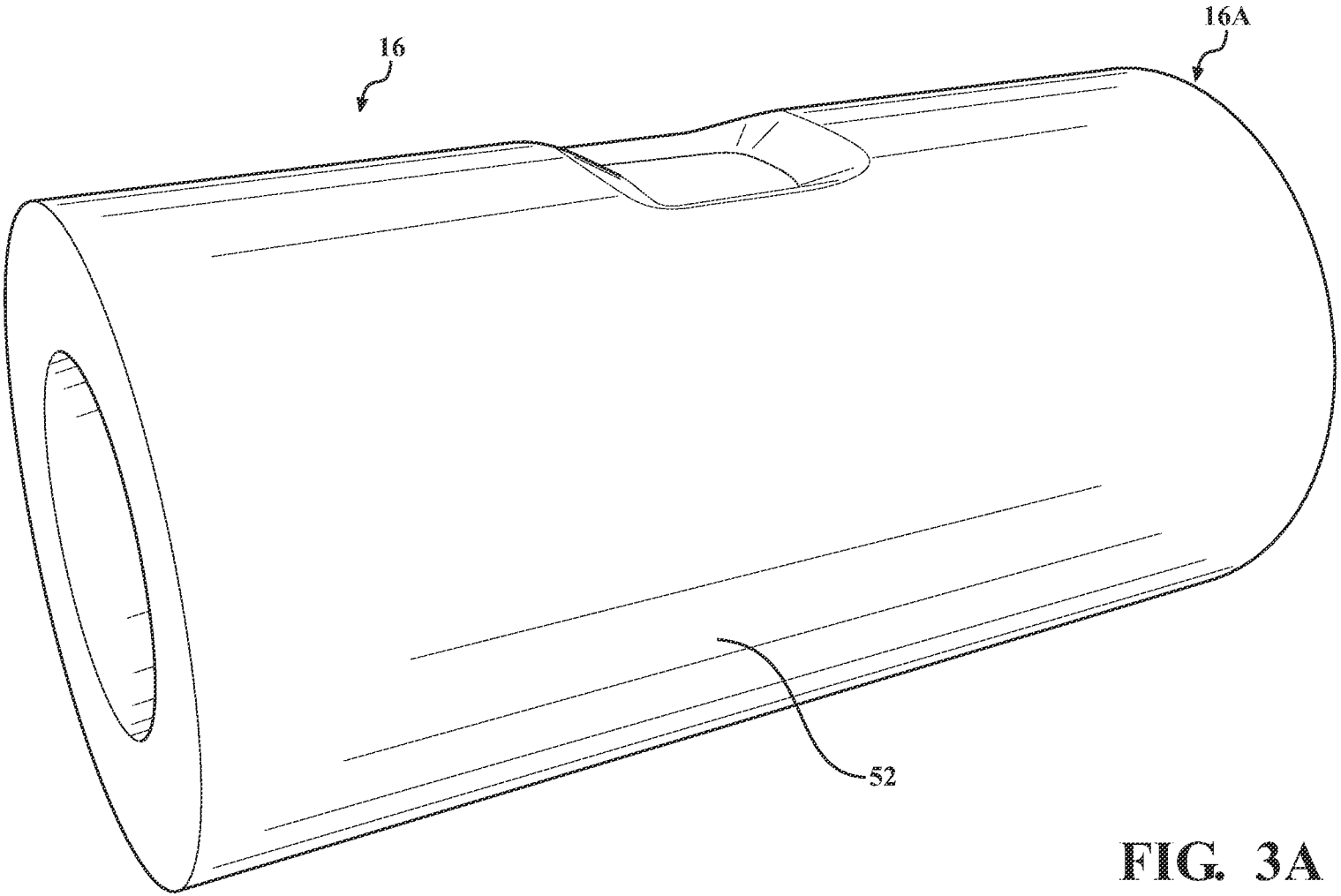
FIG. 3A is a schematic perspective illustration of a mandrel having an outer surface geometry for forming the component shown in FIG. 2, specifically illustrating the mandrel constructed from a dissolvable material, according to the disclosure.
Figure 3B:
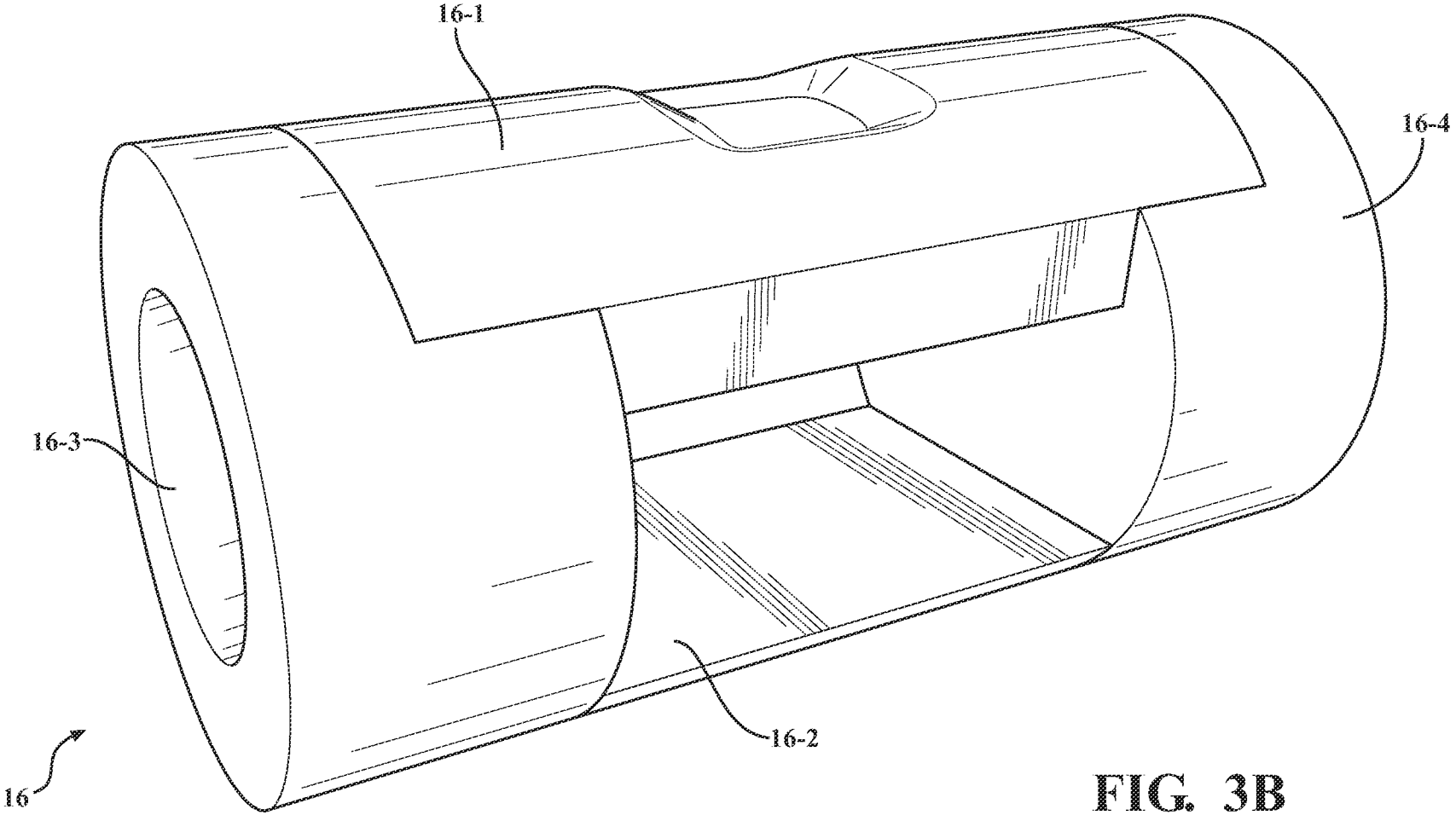
FIG. 3B is a schematic perspective illustration of an embodiment of the mandrel shown in FIG. 3A constructed from multiple individual sections configured to be removed from the formed component shown in FIG. 2, according to the disclosure.
Figure 4A:
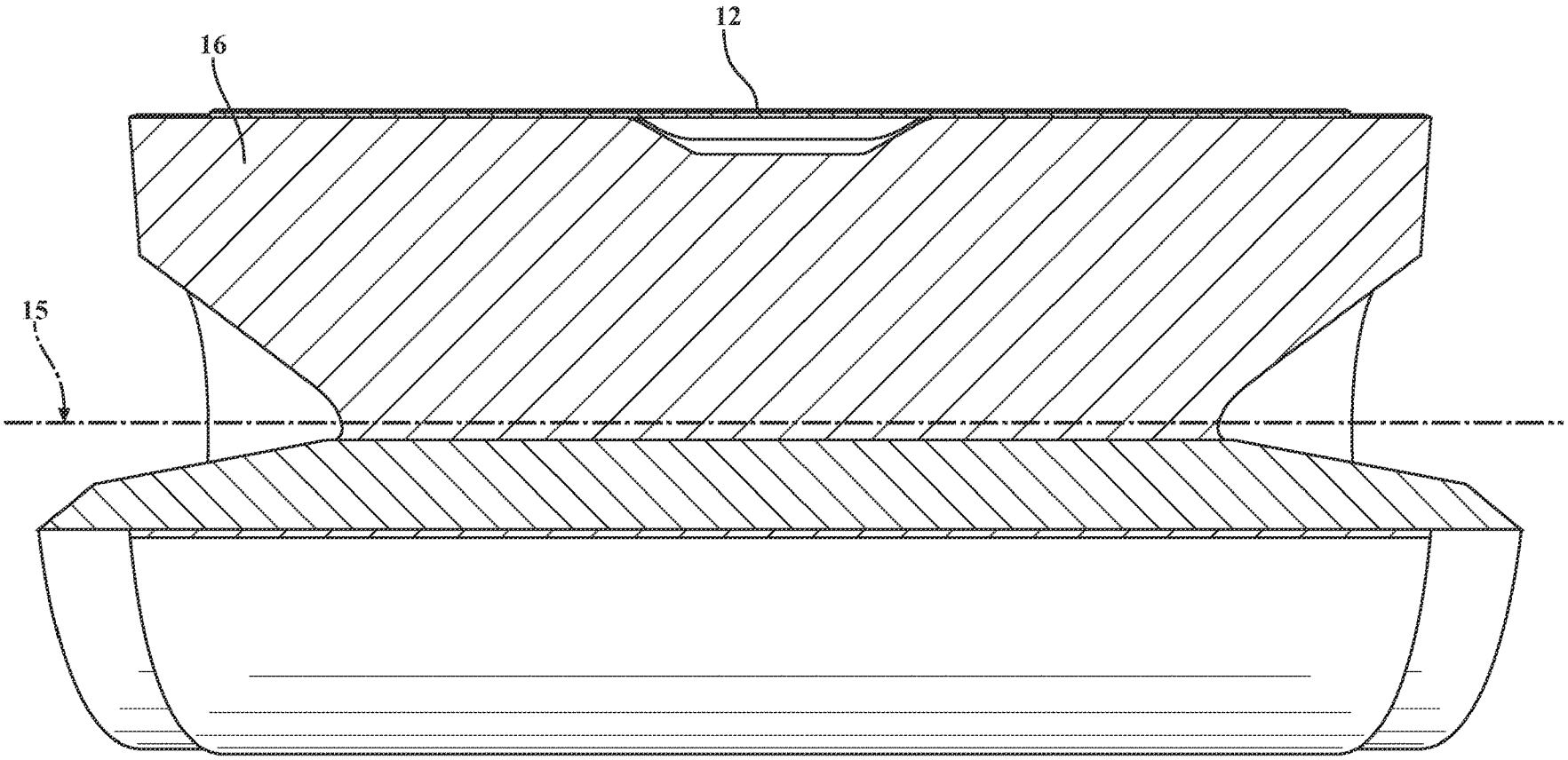
FIG. 4A is a schematic cut-away perspective illustration of a tubular workpiece sleeved over the dissolvable mandrel for manufacturing the non-axisymmetric component shown in FIG. 2.
Figure 4B:
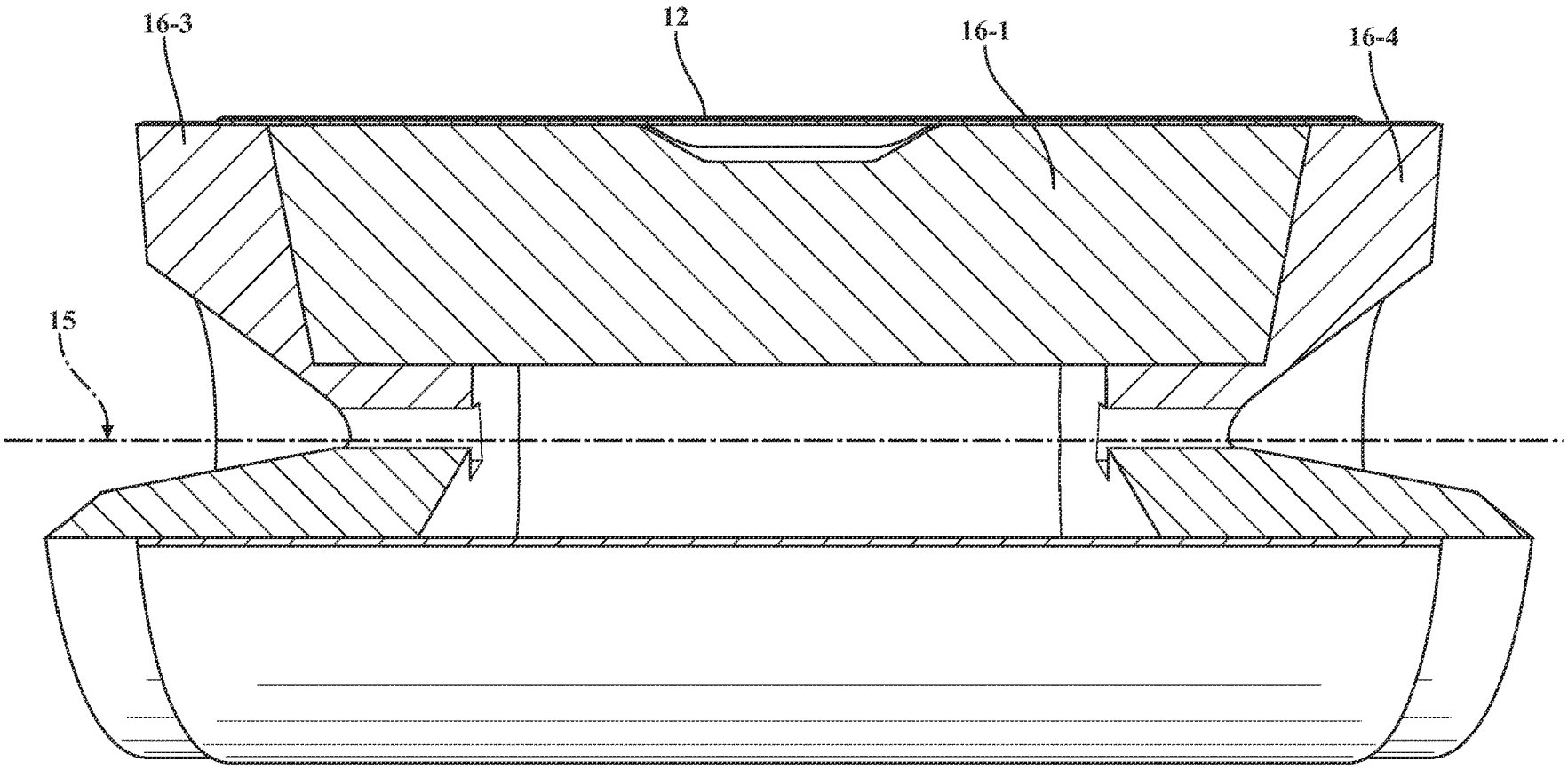
FIG. 4B is a schematic cut-away perspective illustration of a tubular workpiece sleeved over the multi-part mandrel shown in FIG. 3B for manufacturing the non-axisymmetric component shown in FIG. 2.

A tool system 14 for radial incremental forming of the component 10 having the IML 10A is shown in FIGS. 1 and 1A. As shown in FIGS. 3A and 3B, the system 14 includes a mandrel or die 16 having a mandrel outer mold line (OML) 16A. The mandrel OML 16A may be additively manufactured or alternatively may be lathed, machined, or otherwise fashioned from a bar stock of suitable material to produce one or more components that collectively comprise a mandrel. The OML 16A of the mandrel 16 has a surface geometry which mates with the IML 10A of the component 10 in one or more locations. The mandrel 16 is generally configured, i.e., sized and shaped, to be inserted into the tubular workpiece 12, such that the tubular workpiece becomes sleeved over the mandrel, as shown in FIGS. 4A and 4B in a cutaway form.

With resumed reference to FIG. 1, the tool system 14 also includes a drive mechanism 20 configured to mount, hold, and rotate the workpiece 12 sleeved over the mandrel 16 about the axis 15. While the drive mechanism 20 is specifically depicted in FIG. 1 as a computer numerical control (CNC) lathe, such as a 4-axis machine, it is understood that other embodiments may have different drive mechanisms which can be configured to perform the same task. Alternative embodiments of the drive mechanism 20 may, for example, include a multi-axis robot or a 5-axis CNC machine. The CNC lathe drive mechanism 20 may employ a rotatable spindle 22 with chucks 24A, 24B, and 24C centered on the axis 15 and fixed relative to the spindle 22. While in the present embodiment the rotatable spindle 22 has three chucks, other spindle embodiments may have fewer or greater number of chucks. In many embodiments, the drive mechanism 20 is configured to actuate the chucks 24A, 24B, and 24C radially inwards towards axis 15 so that they may firmly grip the workpiece 12 sleeved over the mandrel 16.

The CNC lathe drive mechanism 20 may also include an adjustable tailstock 26 for supporting the opposite end of the mandrel 16. For example, the tailstock may 26 be configured to move horizontally, such as along a guide rail 28. The CNC lathe drive mechanism 20 may additionally include an electric motor (not shown) operatively connected to the spindle 22 and thereby configured to rotate the workpiece 12 sleeved over the mandrel 16 about the axis 15. The CNC lathe drive mechanism 20 additionally employs an electronic processor and servomechanism(s) (not shown) to regulate the rate of movement of the spindle 22. Furthermore, the CNC lathe drive mechanism 20 may include a control panel and display 30 configured to permit monitoring and/or manual control of the forming process.

With continued reference to FIG. 1, the system 14 also includes a forming tool, such as a stylus, 32 having a centerline 33 and mounted into, e.g., inserted and secured within, a collet 34A. As will be described in greater detail below, the forming tool 32 is specifically configured to shift relative to the tubular workpiece 12 and apply a forming force F (shown in FIG. 1A) to the tubular workpiece. In at least one embodiment of the drive mechanism 20, the collet 34A and other collets, such as collets 34B, 34C, 34D, are mounted along the circumference of a tool change carousel 36. This tool carousel 36 may hold multiple forming and/or cutting tools (not shown) and may be connected to a servomechanism (not shown), such that the subject tools may be interchanged automatically. The tool carousel 36 forms part of a lathe turret assembly 38 which is moveable both horizontally and vertically using, for example, guide rails 40 and 42 respectively via servomechanism(s). In at least one alternative embodiment, the drive mechanism 20 may be characterized by an absence of a tool change carousel, such that the collet is directly connected to the moveable lathe turret assembly 38.

As shown in FIG. 1A, the forming tool 32 has an operative tool tip 32A. The tool tip 32A may be hemispherical (as shown) or have another profile which is axisymmetric with respect to the centerline 33 of the forming tool 32. For example, the forming tool 32 may be a solid metal cylinder having a round fillet at the intersection of its flat base and side walls, i.e., the forming tool may have a bullnose shape. As previously mentioned, the forming tool 32 is mounted into a collet 34A which is either connected to the tool change carousel 36 which is in turn part of the lathe turret assembly 38 or, alternatively, directly connected to the lathe turret assembly.

The servomechanism (not shown) which drives the lathe turret assembly 38 is configured to impart at least two degrees of freedom of movement to the forming tool 32. One degree of freedom allows translation of the forming tool 32 in a direction parallel to the axis 15. The other degree of freedom describes movement of the forming tool 32 in a direction which is orthogonal to the axis 15. For example, the axis 15 may be horizontal, i.e., level with ground, and the first degree of freedom may therefore be a horizontal translation of the forming tool 32. Correspondingly, the second degree of freedom in this non limiting example may be configured as a vertical translation of the forming tool 32.

With reference to FIG. 1, the system 14 additionally includes an electronic controller 44, which is in operative communication with the drive mechanism 20 and the lathe turret assembly 38. The electronic controller 44 may be a central processing unit (CPU) of the CNC lathe or a dedicated separate electronic control unit (ECU) having a microprocessor. For example, the ECU may be a FANUC or SIMENS controller, or the like. To support manufacturing the component 10, the electronic controller 44 specifically includes a processor and tangible, non-transitory memory, which includes instructions programmed therein for processing data signals and executing commands. The memory may be an appropriate recordable medium that participates in providing computer-readable data or process instructions. Such a recordable medium may take many forms, including but not limited to non-volatile media and volatile media. Non-volatile media for the electronic controller 44 may include, for example, optical or magnetic disks and other persistent memory. Volatile media may include, for example, dynamic random-access memory (DRAM), which may constitute a main memory.

The instructions programmed into the electronic controller 44 may be transmitted by one or more transmission medium, including coaxial cables, copper wire and fiber optics, including the wires that comprise a system bus coupled to a processor of a computer, or via a wireless connection. Memory of the electronic controller 44 may also be transmitted and/or stored by means of a Universal Serial Bus (USB) device, flexible disk, hard disk, magnetic tape, another magnetic medium, a CD-ROM, DVD, another optical medium, etc. The electronic controller 44 may be configured or equipped with other required computer hardware, such as a high-speed clock, requisite Analog-to-Digital (A/D) and/or Digital-to-Analog (D/A) circuitry, input/output circuitry and devices (I/O), as well as appropriate signal conditioning and/or buffer circuitry. Subsystems and algorithm(s), indicated in FIG. 1 generally via numeral 46, required by the electronic controller 44 or accessible thereby may be stored in the memory of the controller and automatically executed to facilitate operation of the system 14.

The electronic controller 44 is configured, via input from toolpath instructions 48 (generated using method 100 to be described in detail below, or otherwise supplied) to regulate the drive mechanism 20, and specifically the rotation of spindle 22 in concert with the movement of lathe turret assembly 38. In particular, the electronic controller 44 regulates electric motors, e.g., servomotors, such that the rotation of the workpiece 12 about the axis 15, as well as the translations in two orthogonal directions of the lathe turret assembly 38, match the information given by the toolpath 48 for a given time value. At least in some instances, the resulting movement, i.e., magnitude of shift, of the forming tool 32 is intended to cause interference of the forming tool with the workpiece 12, and as a result the forming force F, depicted in FIG. 1A, is applied to the workpiece 12 to thereby generate elastoplastic strain in the workpiece 12. The plastic component of the elastoplastic strain generated via application of the force F causes permanent deformation in the workpiece 12. Accordingly, the workpiece 12 is deformed incrementally, via the described synchronized movements of the mandrel 16 and the forming tool 32, into the desired component 10 having the IML 10A. Although the force F is depicted in 1A as a downwards acting load, it is understood that the angle of force will change depending on the contact between the forming tool 32 and the workpiece 12, and, correspondingly, there may exist a horizontal component of the force F which is not represented in FIG. 1A.

Figure 2:
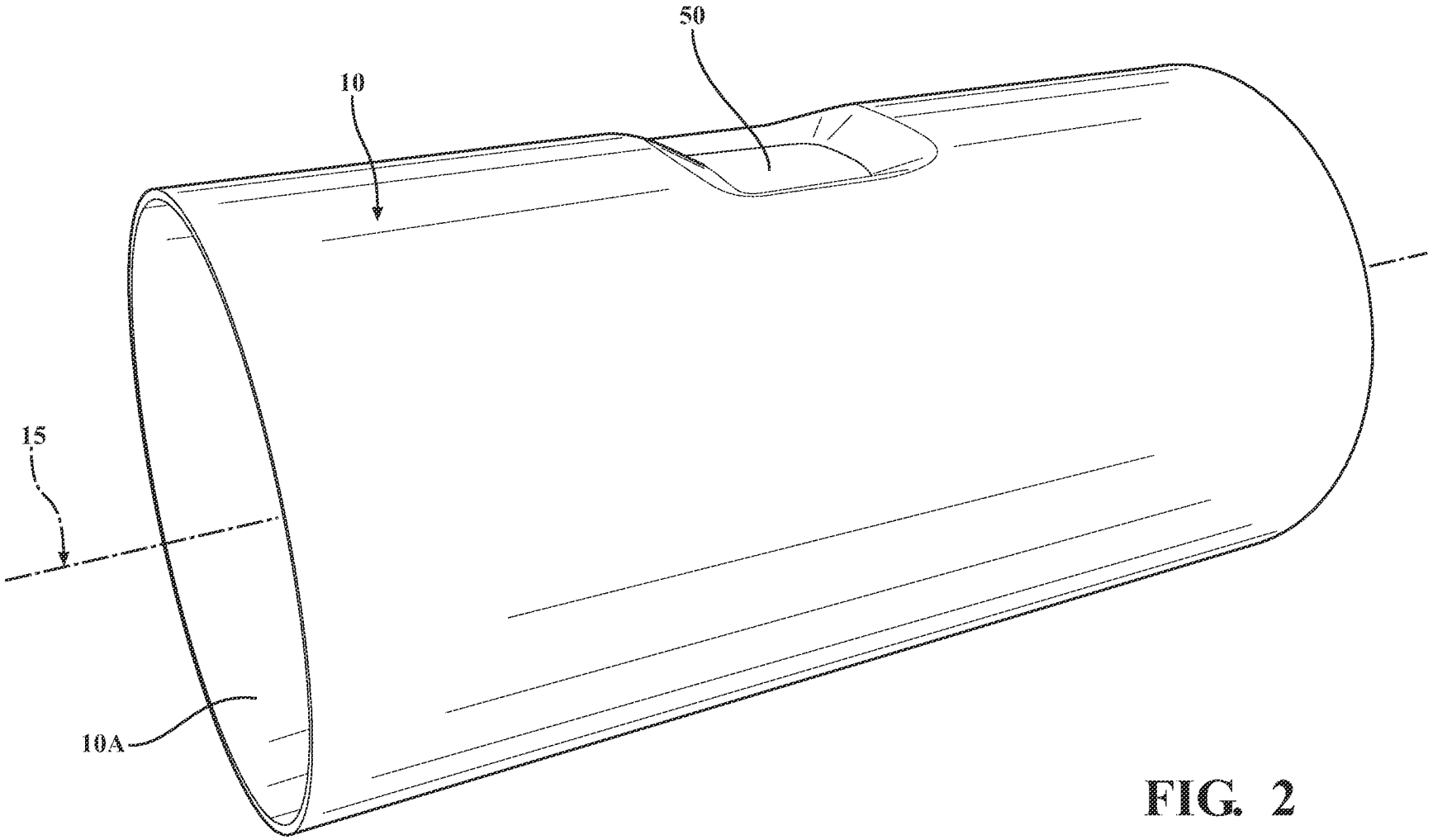
FIG. 2 is a schematic perspective illustration of an example component, according to the disclosure.

Specifically in the embodiment of the component 10 defined by a non-tapered IML 10A, the formed component may interlock with the mandrel 16 once the forming operations are complete. An example of such an embodiment of the component 10 is shown in FIG. 2. In the embodiment of FIG. 2, a pocket 50 is to be formed into the initial tubular workpiece 12. Once forming operations are completed, due to the pocket 50, removal of the mandrel 16 from the formed component 10 may pose a challenge. To address such an eventuality, the mandrel 16 may be constructed from a material 52 configured to be dissolved in a fluid, such as water. For example, the mandrel 16 may be machined from a block of Aquacore™ or SOLCORE™. FIG. 3A shows an embodiment where the mandrel 16, designed to form the basis for the component 10, is to be constructed with the subject dissolvable material 52. The dissolvable material 52 is intended to enable the mandrel 16 to be removed from the formed component 10 without disturbing the component IML 10A. To dissolve the mandrel 16, the formed component 10 with the mandrel maintained therein would be soaked in the fluid for a predetermined amount of time.

Alternatively, the mandrel 16 may be constructed from multiple individual sections, such as sections 16-1, 16-2, 16-3, and 16-4 as shown in FIG. 3B. Sections 16-1, 16-2, 16-3, and 16-4 are specifically configured to be removed from the formed component 10 without disturbing the component IML 10A. For example, sections 16-3 and 16-4 may be removed from either end of the formed component first, thereby freeing up space to allow the removal of remaining sections 16-1 and 16-2. The sections 16-1 and 16-2 may then be removed from the formed component 10 in any desired order. In a multi-part mandrel 16 configuration, such as that disclosed in FIG. 3B, the material may be any combination of one or more of polymer, timber, fiber board, metal, fiber, glass, or carbon fiber reinforced plastic (CFRP).

Figure 15:
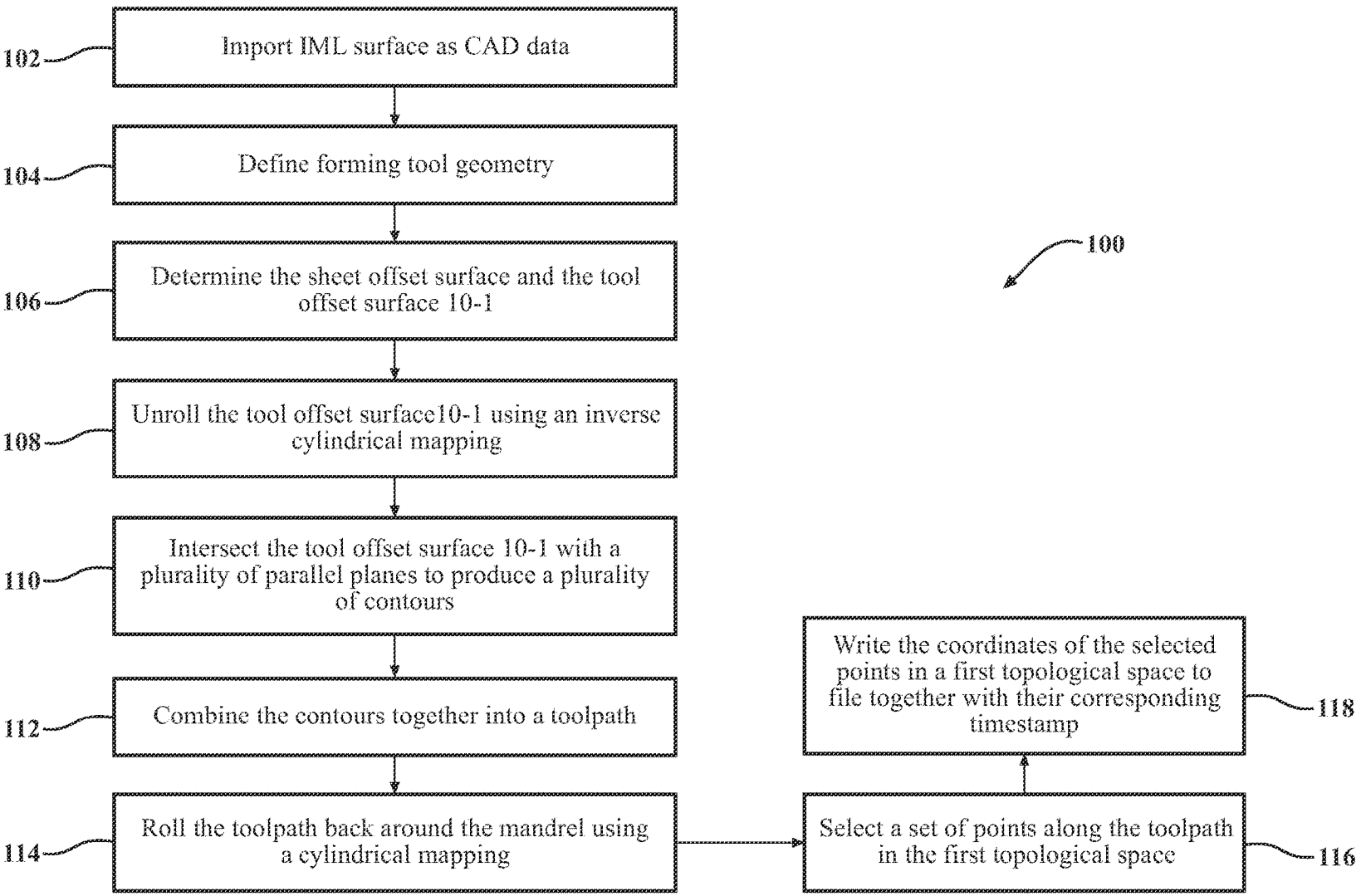
FIG. 15 is a flow chart illustrating a method of generating a toolpath for use during radial incremental forming shown in FIGS. 1-13.

The electronic controller 44 may be programmed with an ASCII text file having toolpath instructions 48, such as GCODE, to command the tool system 14 to drive the forming tool 32 and the spindle 22, such that the forming tool is in its requisite position relative to the workpiece 12 for each instance of time values specified in the file. Such a file is generally referred to as a "toolpath", and is typically, but not necessarily, generated by a software program external to the electronic controller 44 and stored among the previously noted algorithm(s) 46 (shown in FIG. 1). The subject program may also be referred to as a toolpath generation program or Computer Aided Manufacturing (CAM) software. FIG. 15 depicts an exemplary method 100, that describes, in simplified form, a toolpath generation program for creating a useable toolpath (e.g., the toolpath instructions 48) for radial incremental forming of the component 10, constructed as set forth herein. The created toolpath is then executed as code or instructions by an electronic control unit, such as the electronic controller 44 of the exemplary tool system 14 shown in FIG. 1. Specifically, the toolpath instructions 48 may include multiple sets of coordinates, wherein each set of subject coordinates identifies a mandrel 16 rotation, an axial shift of the forming tool 32, and a radial shift of the forming tool at a predetermined time instance relative to commencement, i.e., time zero, of the component 10 forming process.

The method 100 initiates in Block 102, where a part geometry for the component 10 is input into a toolpath generation program, e.g., by uploading a corresponding CAD file into Block 102. The subject CAD file includes at least a digital definition of a surface geometry of the component 10 which defines the IML 10A. Such a CAD file may describe a set of trimmed parametric surface entities and their related entities, such as edges and vertices, for example with STEP, Parasolids, ACIS, or IGES files. Alternatively, the file may describe a set of vertices and connecting polygons, such as is the case with STL, PLY, VRML files, or the like. Furthermore, the CAD data in Block 102 may be in the form of a native file format to CAD software, such as 3DEXPERIENCE®, CATIA®, SOLIDWORKS®, CREO®, SOLIDEDGE®, Siemens NX®, or the like. Specifically, at Block 104, the geometry of the forming tool 32 is defined by providing an outer diameter and a cross section for the tool tip 32A. For example, a circular cross section shape and an outer diameter of 30 mm would be selected if a 30 mm diameter hemispherical forming tool is to be used. Other diameters and cross sections shapes are possible.

Figure 5:
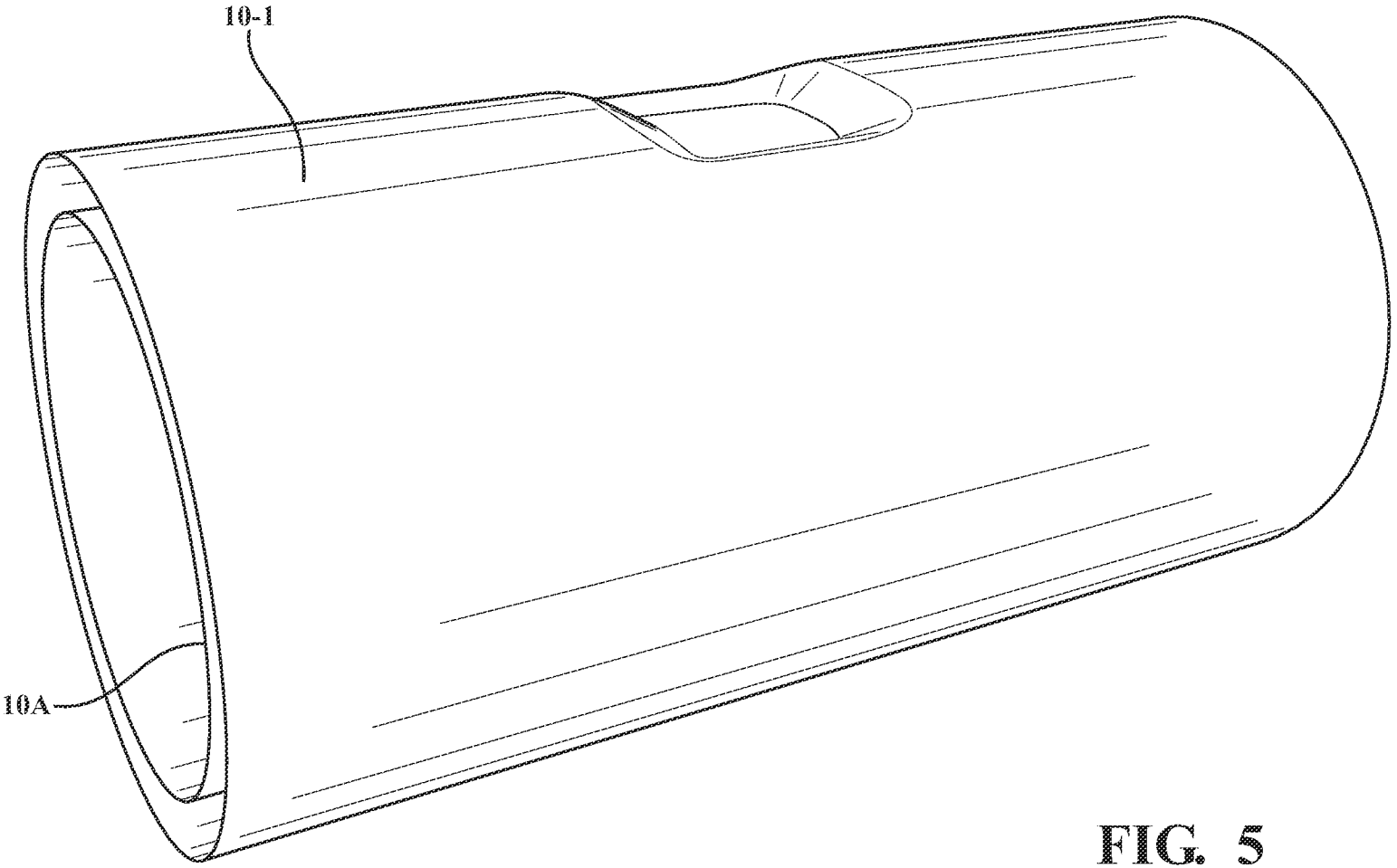
FIG. 5 is an illustration of an offset surface used to generate a CNC toolpath of the forming tool shown in FIG. 2.

At Block 106, the method 100 includes determining a sheet offset surface of the component 10 (shown in FIG. 5). The subject approach includes initially determining a sheet offset surface of the workpiece 12 via offsetting the geometry of the component 10 by a prescribed distance normal to the surface of the workpiece 12 (which may be the workpiece material thickness) to allow space for the deformed workpiece to lie between the tool tip 32A and the mandrel 16. Block 106 may be excluded from the method 100, if the workpiece material thickness variable is properly accounted for in Block 104. The method then proceeds to generate a further offset surface based on the sheet offset surface, which accounts for the forming tool 32 shape. The subject further offset surface, defined as the tool offset surface 10-1, satisfies the property that when a specified reference point on the forming tool 32 is coincident with a point on the tool offset surface 10-1, the forming tool will contact the sheet offset surface without intersecting. In other words, if the forming tool 32 is positioned with its reference point anywhere on the tool offset surface 10-1, it will just touch the sheet offset surface. FIG. 5 illustrates one possible tool offset surface 10-1 corresponding to forming the component 10 shown in FIG. 2.

The tubular initial shape of the workpiece 12 means that it is often desirable to incrementally deform the workpiece along contours which are a constant distance away from the axis 15, about which the mandrel 16 is rotated. To facilitate a toolpath with the subject property, the method 100 proceeds, at Block 108, to transform or map the tool offset surface 10-1 from its existing topological space, i.e., a first topological space, into a second topological space via inverse cylindrical mapping. Such a transformation may be visualized as a map which unrolls the surface geometry so that it is flat in regions which are a constant distance away from axis 15 in the first topological space. Specifically, the coordinates of in the subject map are translated from a solid cylinder into a Euclidean space. The inverse cylindrical map $\phi^{-1}$: $\mathbb{R}^3 \rightarrow \mathbb{R}^3$ referred to herein takes in three coordinates x, y, z and returns three coordinates u, v, w as follows:

$$u = y$$

$$v = r_0 \tan^{-1}\left(\frac{z}{x}\right)$$

$$w = \sqrt{x^2 + z^2}$$

The above relationships refer to a tube having the axis 15 coincident with the y axis in a first topological space transforming to a second topological space, where subject cylinders are mapped into w planes. The variable $r_0$ may be chosen as any positive real number and is solely used for the purposes of scaling the transformed shape to aid in visualization. For example, a value of $r_0$=1 may be used. Thus, the subject transformation permits the circular wall of a cylinder, such as characterizing the workpiece 12, to be mapped into a flat and level plane.

Figure 6A:
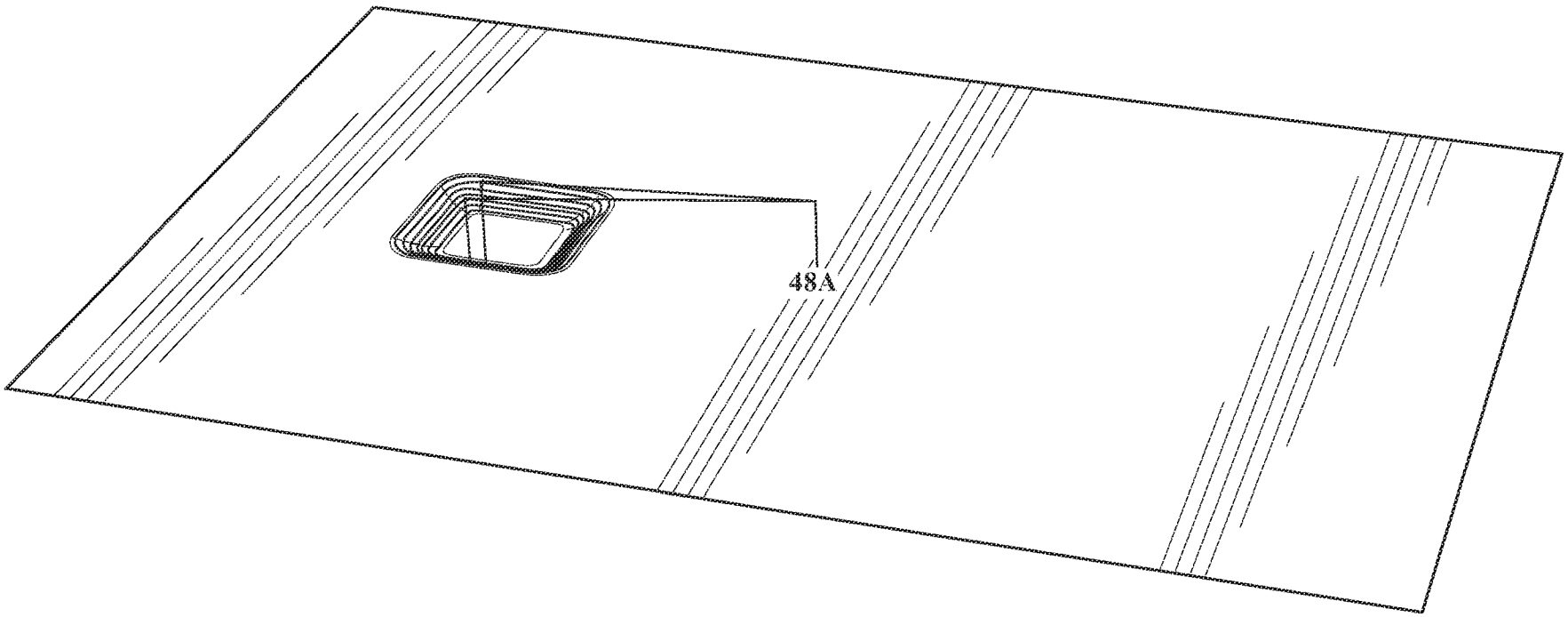
FIG. 6A is an illustration of the toolpath offset surface for the component shown in FIG. 2, depicted in a second topological space, as well as a radial level toolpath for the same component also depicted in the second topological space.
Figure 6B:
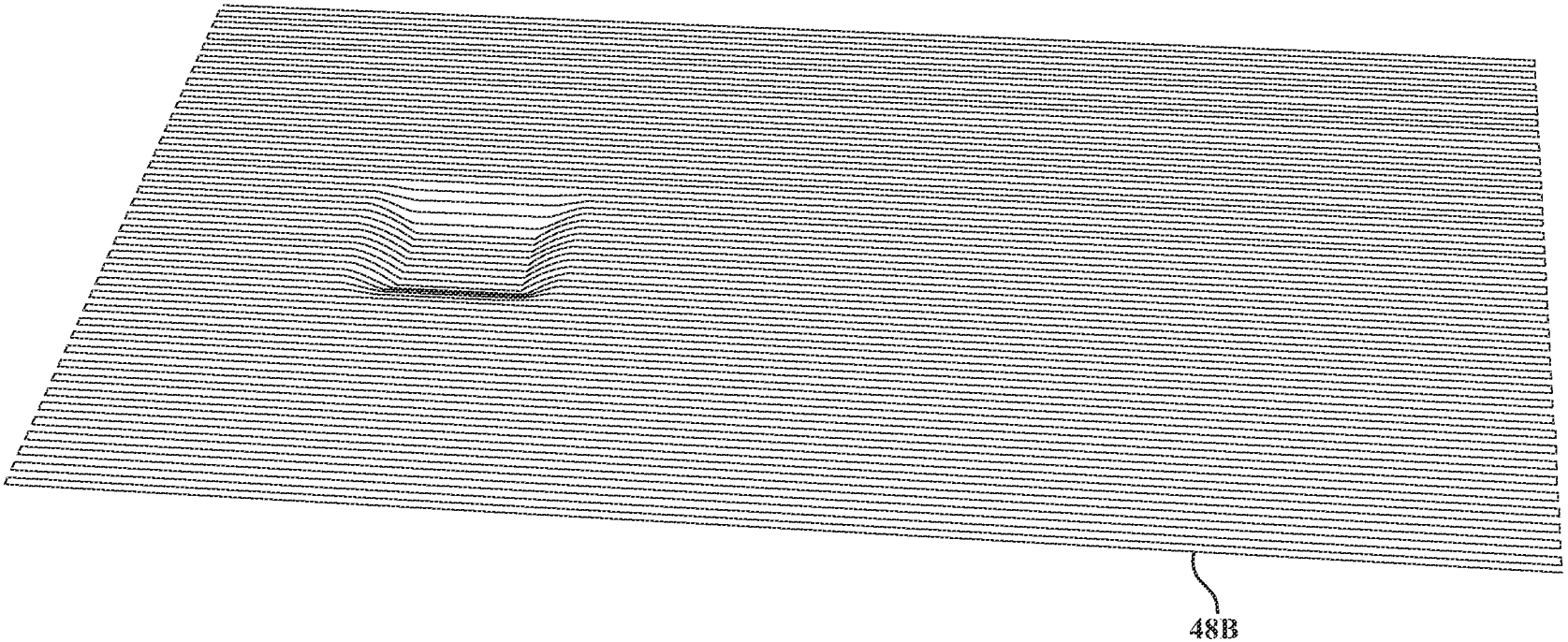
FIG. 6B is an illustration of a lace toolpath for the component shown in FIG. 2, depicted in a second topological space.

At Block 110 the tool offset surface 10-1 geometry defining the IML 10A in the second topological space is intersected with a plurality of parallel planes, defined in the second topological space, to obtain a plurality of toolpath contours connected to form a toolpath in the second topological space. At Block 112 the contours obtained in Block 110 are then combined to form toolpath instructions 48 for the forming tool 32 in the second topological space. FIG. 6A illustrates an exemplary toolpath generated by planes of constant value w which are equally spaced apart in the second topological space and parallel to the flat portions of the tool offset surface 10-1 in the second topological space (i.e., equally spaced level planes in the second topological space). Toolpaths thus produced by level planes will herein be referred to as "radial level" toolpaths 48A. Alternatively, a plurality of equally spaced planes in a direction orthogonal to the flat portions of the tool offset surface 10-1 are illustrated in FIG. 6B. Toolpaths thus produced by orthogonal planes (i.e., planes of constant u value or planes of constant v value or any linear combination thereof) will herein be referred to as "lace" toolpaths 48B.

At Block 114 the method 100 proceeds to transform the toolpath from the second topological space back into the first topological space using cylindrical mapping. Such a transformation may be visualized as wrapping the toolpath around the mandrel 16. The cylindrical map $\phi$: $\mathbb{R}^3 \rightarrow \mathbb{R}^3$ referred to herein takes in three coordinates u, v, w and returns three coordinates x, y, z as follows:

$$x = w\cos(v/r_0)$$

$$y = u$$

$$z = w\sin(v/r_0)$$

The above relationships refer to a second topological space where w planes are mapped back into cylinders which have centerlines which are coincident with the y axis in a first topological space. The value of $r_0$ but should be consistent with the value chosen for the inverse map.

At Block 116 a plurality of points is selected from among the points spaced along the toolpath 48 in the first topological space. As described above, each of the plurality of points may be defined by one of the sets of coordinates representing the mandrel 16 rotation, the axial shift of the forming tool 32, and the radial shift of the forming tool 32 at the predetermined time instance relative to commencement of forming the component 10. The selected points may therefore represent, for a given value of time relative to the start of the operation, the required position of the forming tool 32 together with the required mandrel 16 rotation, where each required position(s) and rotation(s) is relative to a given reference point on the forming tool. At Block 118 the coordinates of the selected points are then saved to a file together with a timestamp which corresponds to the appropriate time value at which the subject rotation of the mandrel 16 and the attendant translational position of forming tool 32 are required. In other words, the resultant file provides a time value for each rotation of the mandrel 16 and the corresponding position of the forming tool 32. The subject saved file may be in an ASCII text file format such as G-code or Aptsource instructions, readable by the electronic controller 44.

Figure 8:
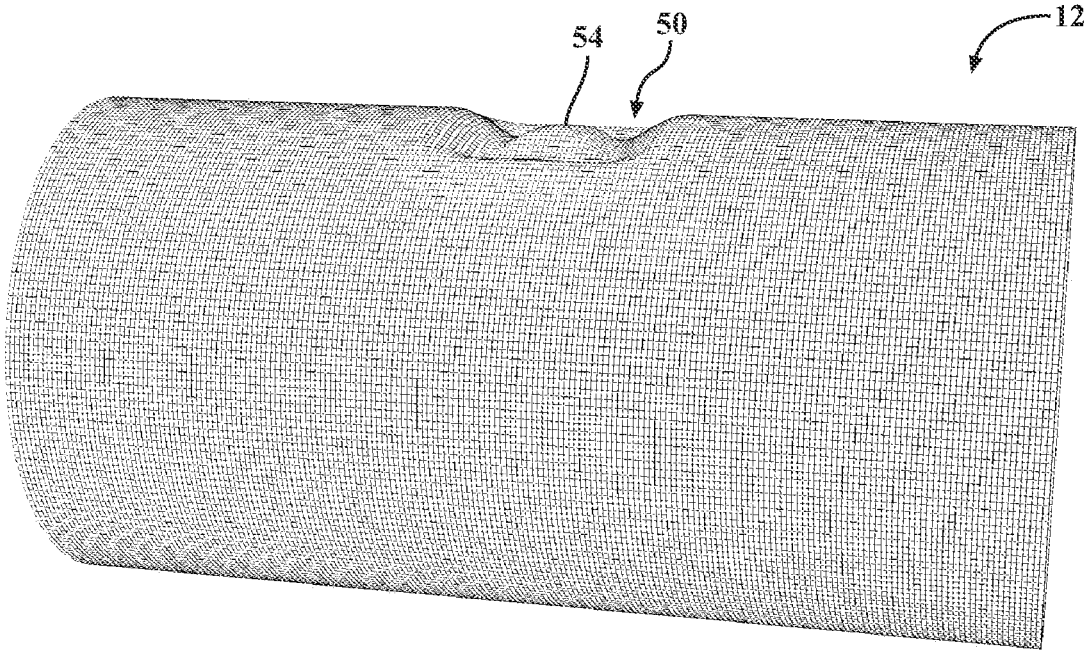
FIG. 8 is a perspective illustration depicting a simulation of the manufacturing of the component shown in FIG. 2, via radial incremental forming, using the CNC toolpath shown in FIG. 7A.

For several reasons, application of the force F along the radial level toolpath may generate significant springback of the tubular workpiece 12 material. Firstly, curling of the workpiece 12 typically occurs along the toolpath in a direction orthogonal to both the motion of the forming tool 32 and the forming tool centerline 33. Secondly, as the radial levels increase in depth, the workpiece 12 material is being compressed into an increasingly smaller space, thereby risking localized buckling of the sheet. Combined, the above noted effects create a strong likelihood of a phenomena referred to as oil canning, whereby a pillow shaped portion of workpiece 12 material is observed at the base of the pocket 50 type feature. This oil canning phenomenon is well known to those skilled in the art of Incremental Sheet Forming (ISF). FIG. 8 illustrates a finite element simulation result showing the deformed workpiece 12 after the radial level toolpath shown in FIG. 7A has been completed. FIG. 8 depicts a pillow of localized springback 54 that is due to the aforementioned oil canning phenomenon.

Figure 7A:
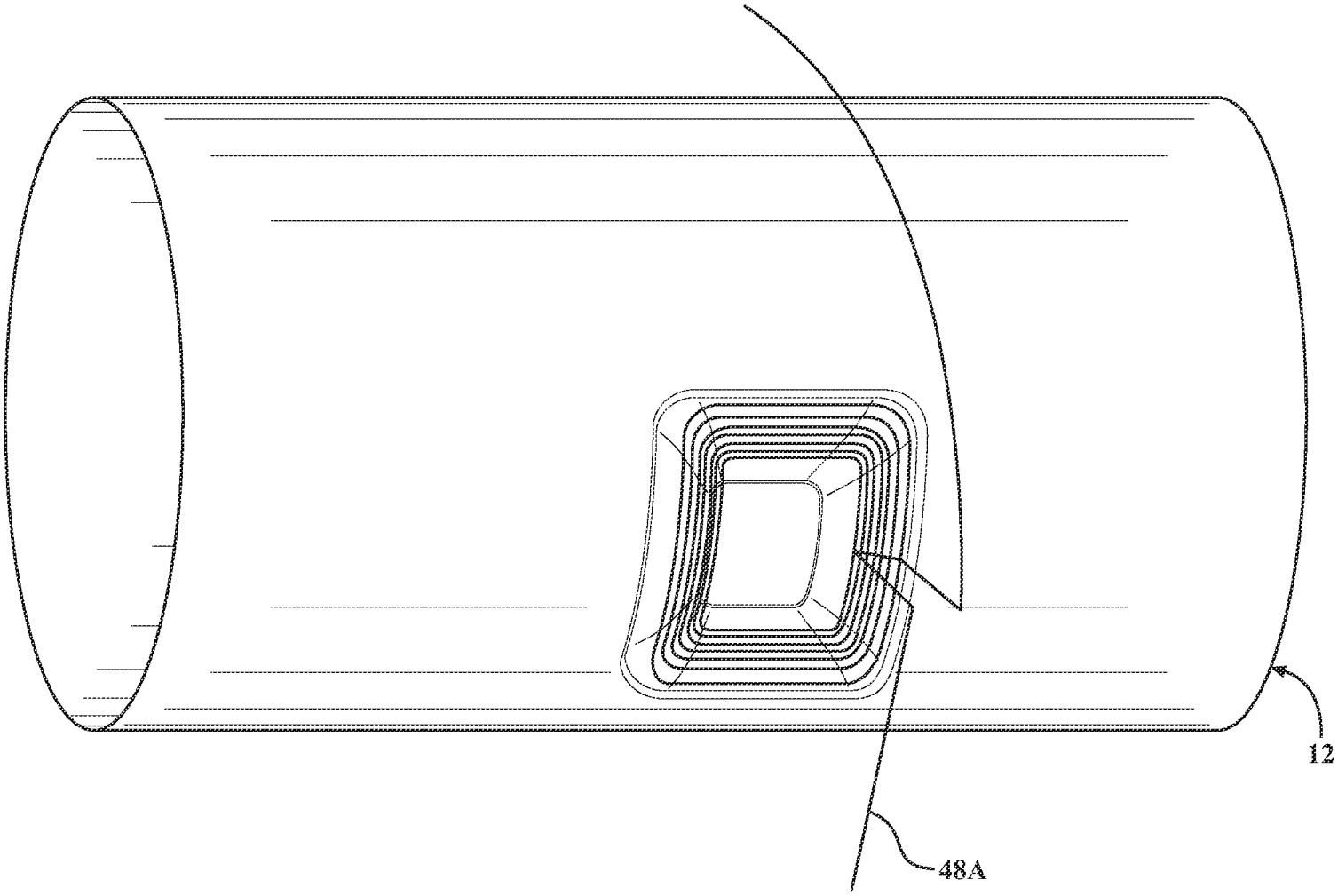
FIG. 7A is an illustration of the embodiment shown in FIG. 6A, depicted in a first topological space.
Figure 7B:
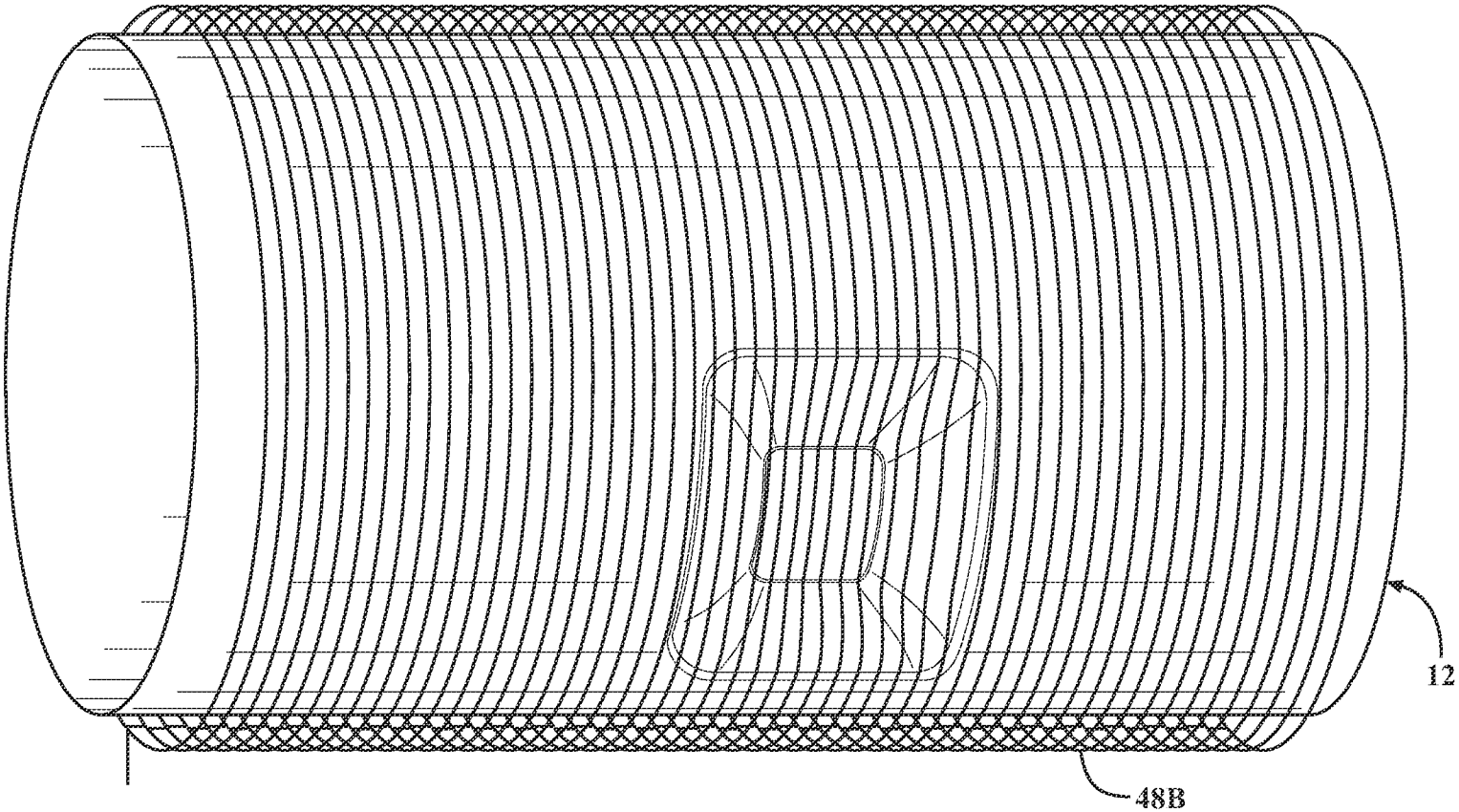
FIG. 7B is an illustration of the embodiment shown in FIG. 6B, depicted in a first topological space.
Figure 9:
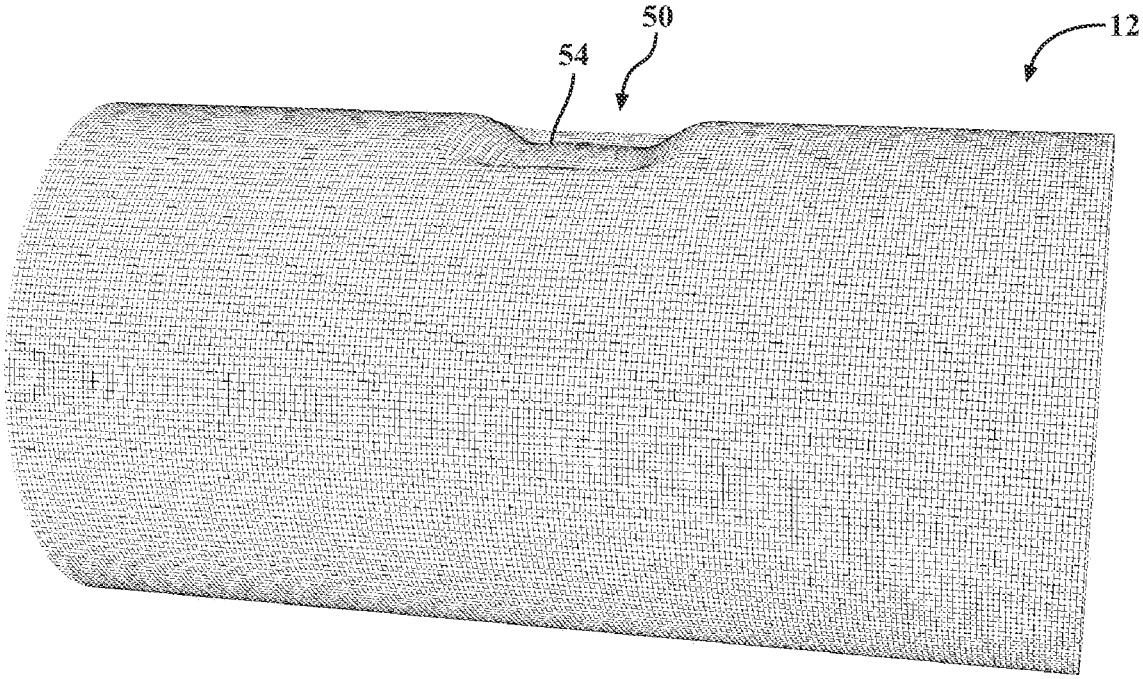
FIG. 9 is a perspective illustration depicting a simulation of the manufacturing of the component shown in FIG. 2, via radial incremental forming, using the CNC toolpath shown in FIG. 7A and the CNC toolpath shown in FIG. 7B.

It has been observed that the issue of oil canning may be effectively mitigated by performing the lace toolpath 48B. The lace toolpath 48B, as detailed previously and illustrated in FIG. 7B, includes connected ring-shaped contours which follow along the component IML 10A. FIG. 9 is an illustration of a finite element simulation result showing the deformed workpiece 12 after both the radial level toolpath 48A of FIG. 7A and the lace toolpath 48B of FIG. 7B have been completed. As depicted in FIG. 7B, the pillow of localized springback 54 has been mostly eliminated through the action of the lace toolpath 48B following the radial level toolpath 48A, leaving the IML of the workpiece 12 in the vicinity of the pocket 50 much closer to the desired component IML 10A.

Figure 10:
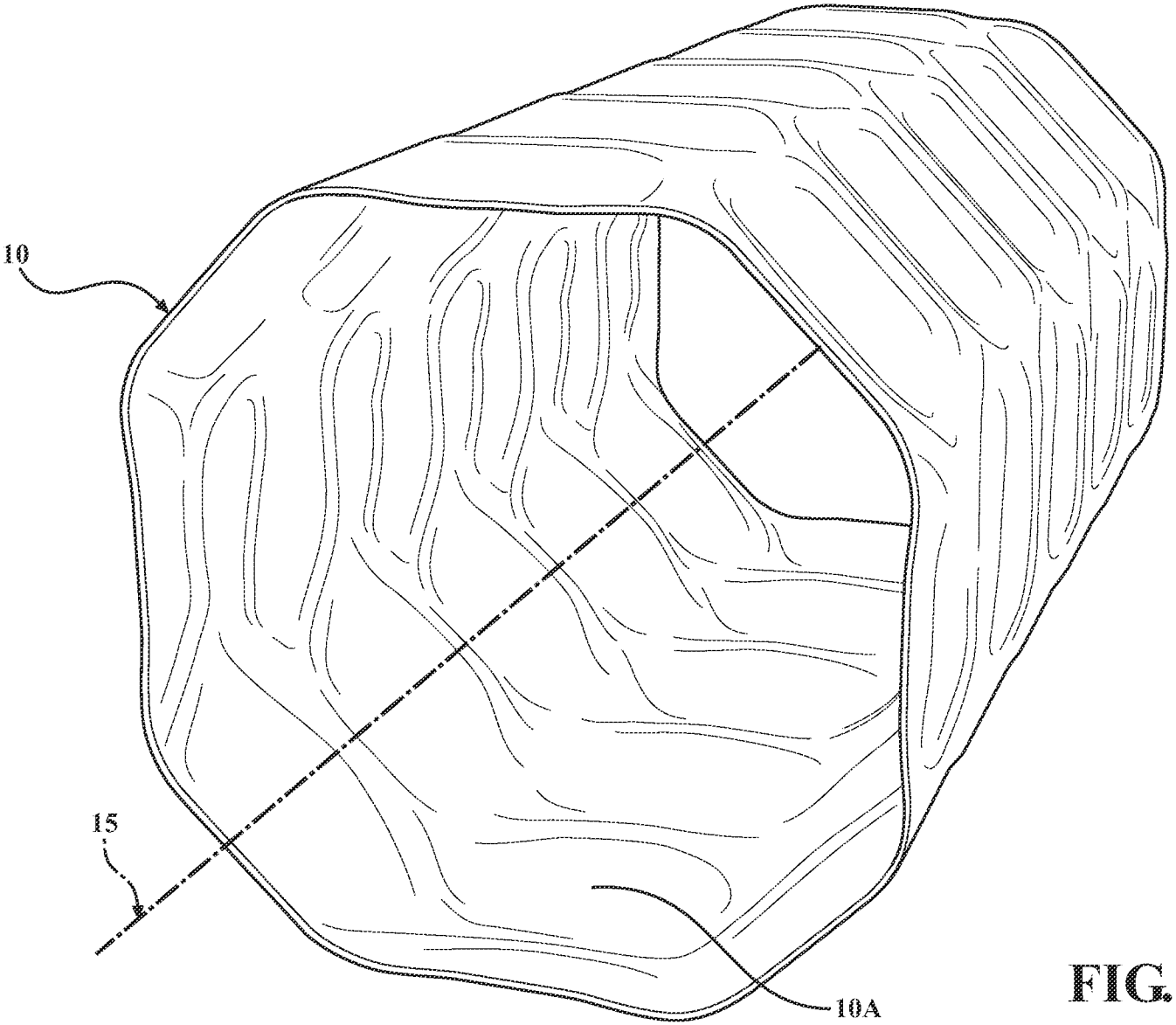
FIG. 10 is a schematic perspective illustration of a further example component, according to the disclosure.
Figure 11A:
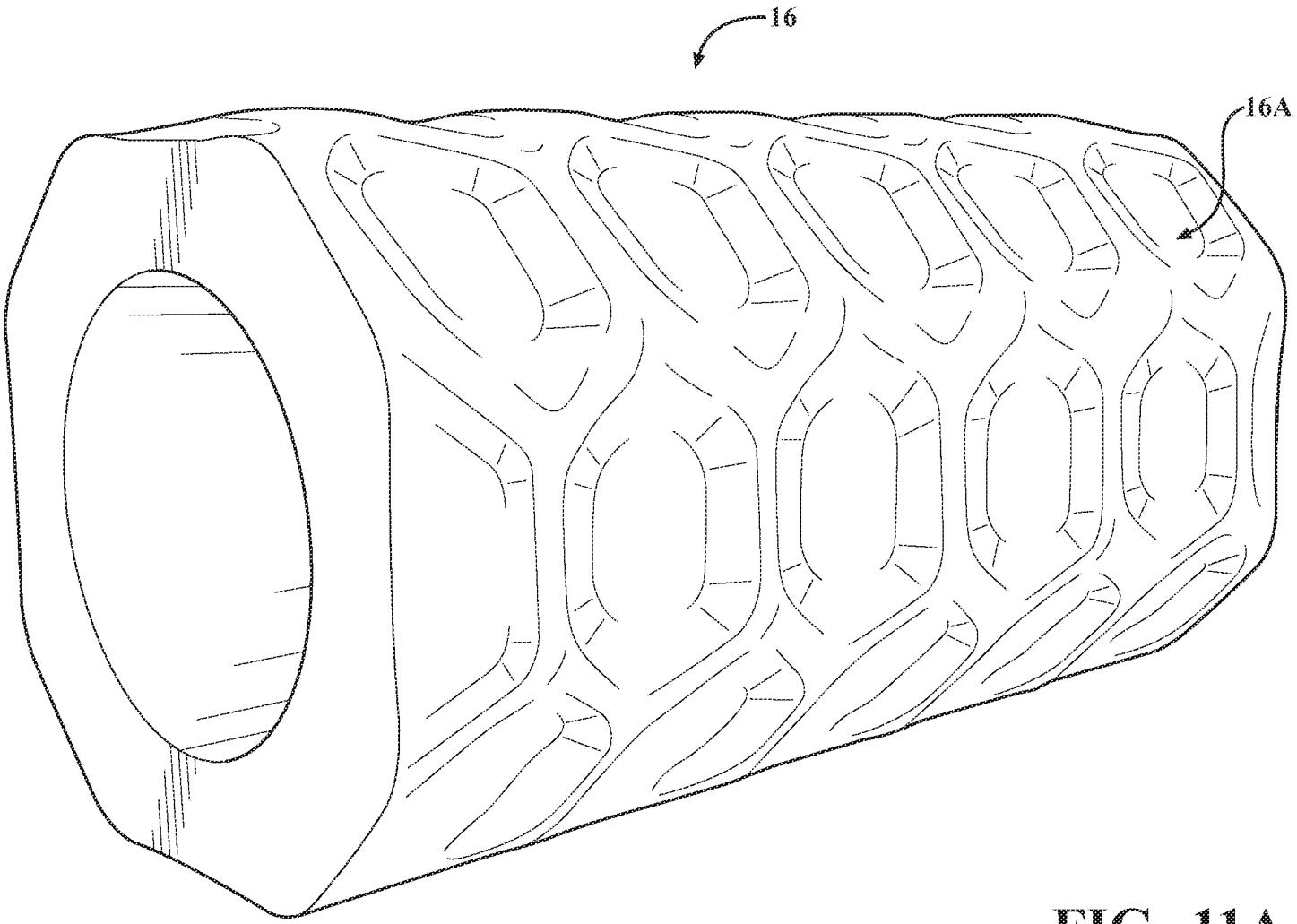
FIG. 11A is a schematic perspective illustration of a mandrel having an outer surface geometry for forming the component shown in FIG. 10, specifically depicting the mandrel constructed from a dissolvable material, according to the disclosure.
Figure 11B:
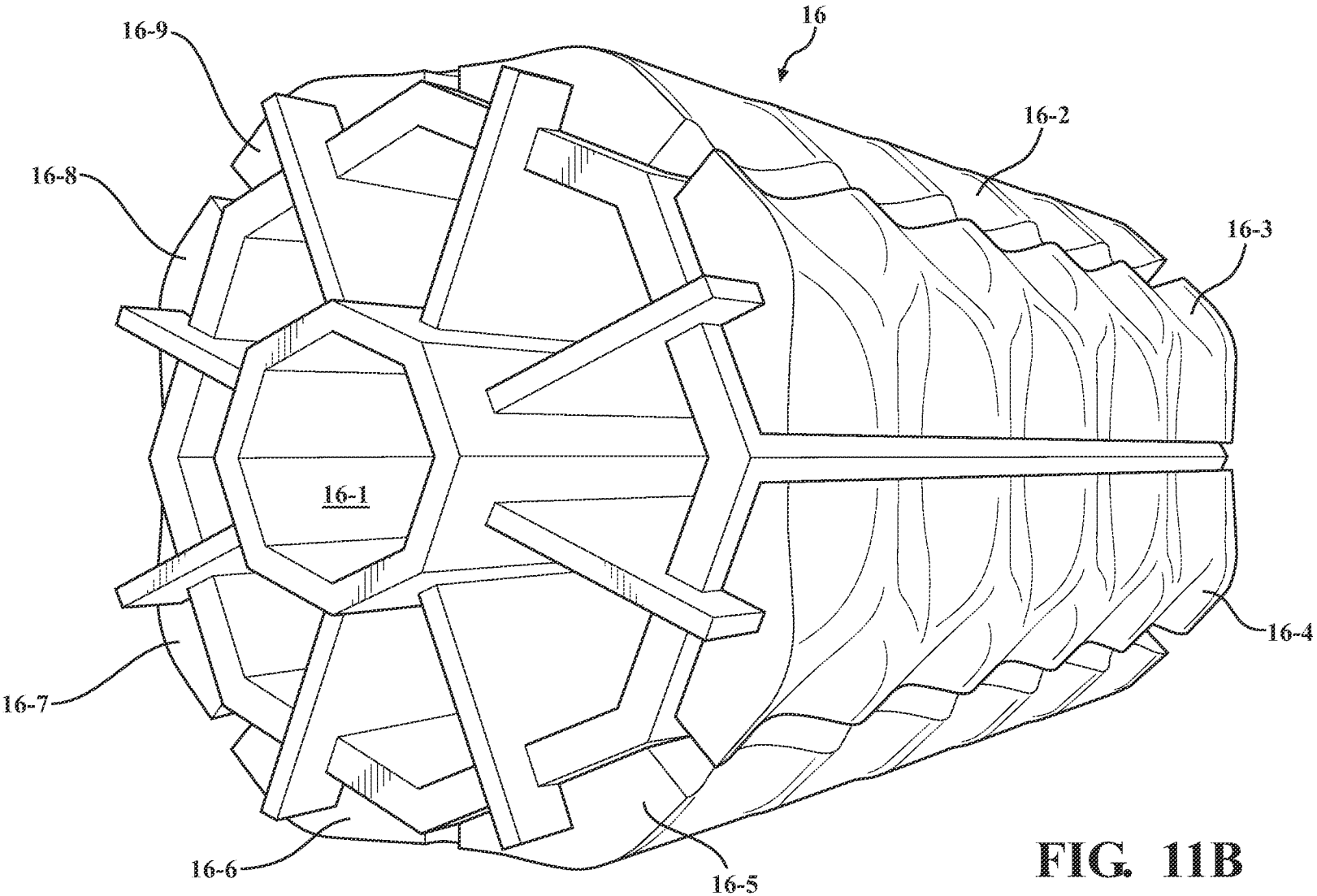
FIG. 11B is a schematic perspective illustration of an embodiment of the mandrel shown in FIG. 11A constructed from multiple individual sections configured to be removed from the formed component shown in FIG. 10, according to the disclosure.

FIG. 10 shows the component 10 with alternative geometry, having a more complex IML as compared to the embodiment of the component 10 shown in FIG. 2, with corresponding IML 10A and axis 15 for the purpose of illustrating capabilities of the radial incremental forming process. FIG. 11A shows a possible embodiment of the dissolvable mandrel 16, while FIG. 11B shows a possible embodiment of a multi-part mandrel 16, each suitable for radial incremental forming of the component 10 shown in FIG. 10. With reference to FIG. 11B, the mandrel assembly 16 includes a section 16-1 having an inner hub, an outer hub, and connecting plates arranged therebetween in the forms of spokes. The mandrel assembly 16 of FIG. 11B also includes sections 16-2 to 16-9. Mandrel sections 16-2 through 16-9 are designed to come into contact with the workpiece 12 during forming of the corresponding component 10. Following the forming operations, section 16-1 may be slid out of the mandrel assembly 16, thereby providing sufficient clearance for parts 16-2 to 16-9 to be removed in any desired order.

Figure 12:
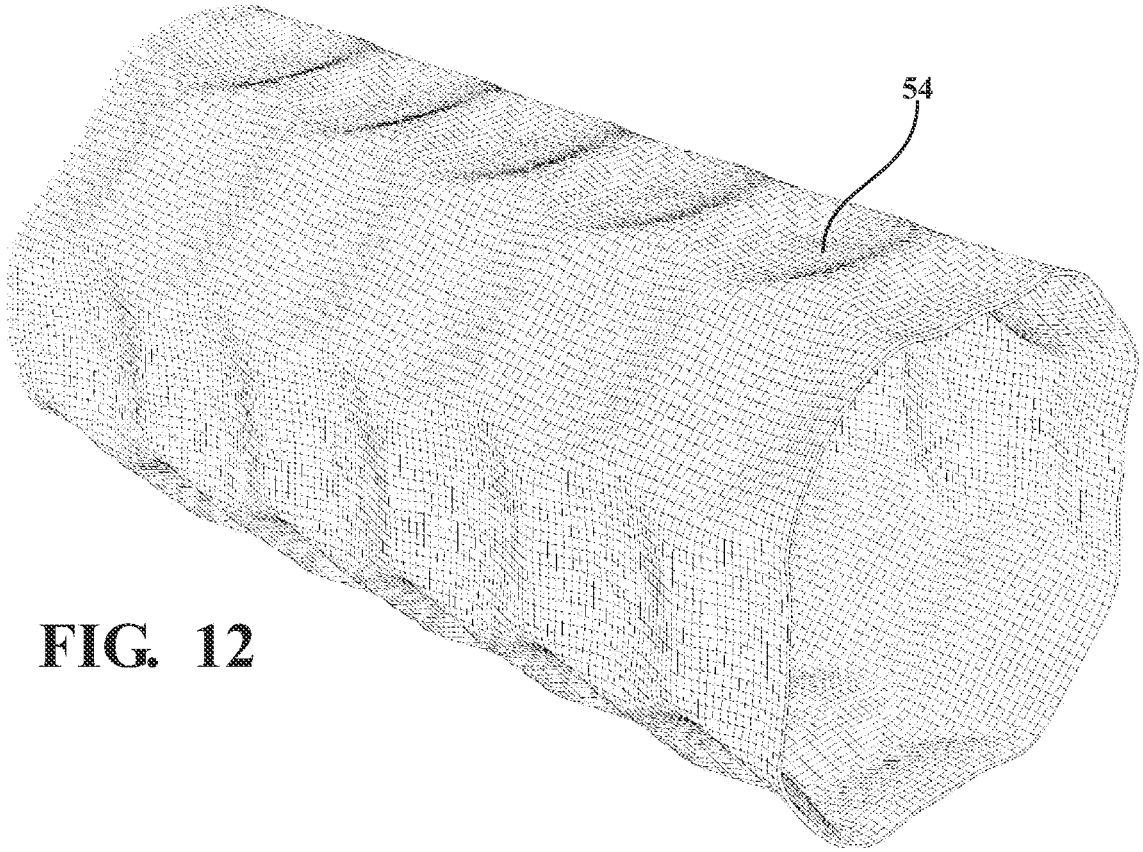
FIG. 12 is a perspective illustration of a simulation of manufacturing the component shown in FIG. 10, via radial incremental forming, with the component depicted after a radial level toolpath (not shown) has been applied, but prior to application of a lace toolpath (not shown).
Figure 13:
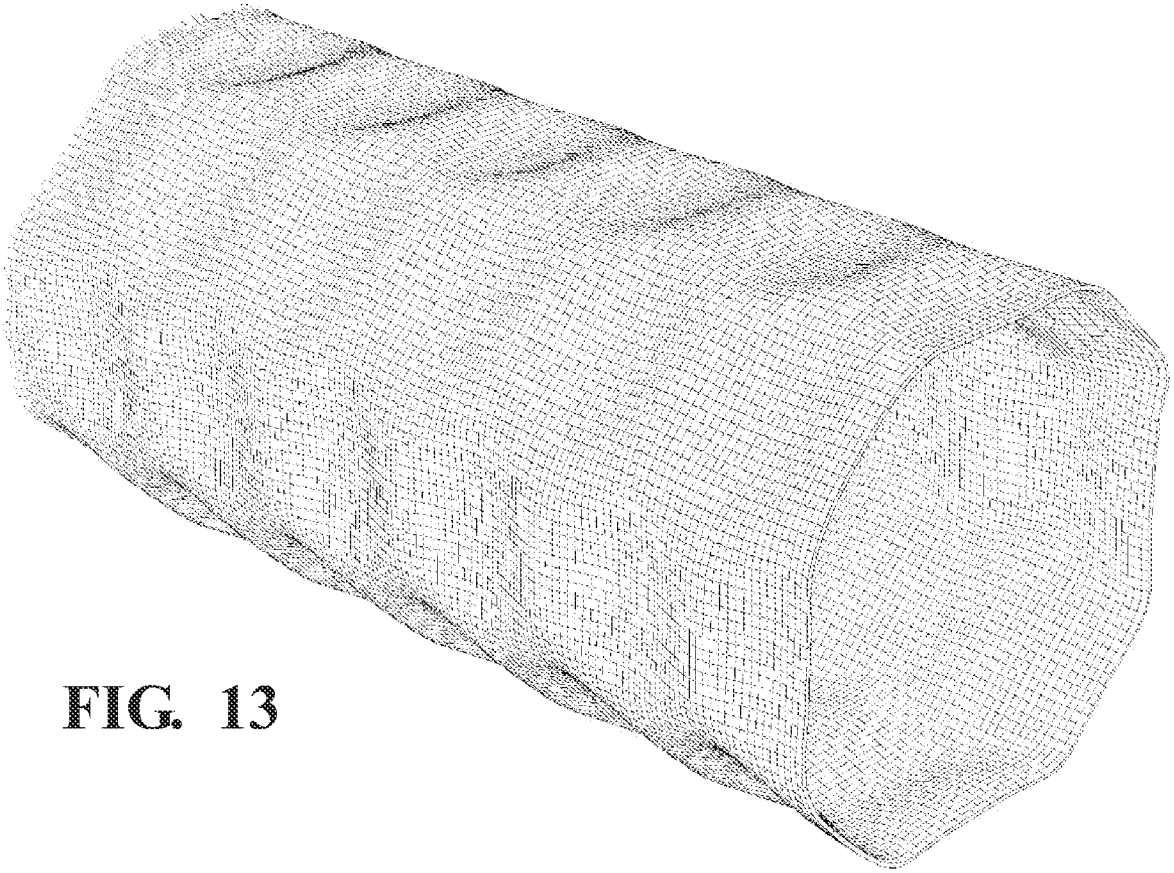
FIG. 13 is a perspective illustration showing a simulation of manufacturing the component shown in FIG. 10, via radial incremental forming, with the component depicted after both a radial level toolpath (not shown) and a subsequent lace toolpath (not shown) have been completed.

FIG. 12 illustrates a finite element simulation result of the deformed workpiece 12 after the radial level toolpath 48A (not shown) has been completed. FIG. 12 contains multiple pillows of localized springback 54 due to the aforementioned oil canning phenomenon. FIG. 13 illustrates a finite element simulation result showing the deformed workpiece 12 after the radial level toolpath 48A (not shown) and the lace toolpath 48B (also not shown) have been completed. As discussed with respect to the previous embodiment of the workpiece 12, the lace toolpath 48B may be employed to significantly reduce the oil canning effect produced by the radial level toolpath 48A. Accordingly, as may be seen in FIG. 13, the previously shown pillows of localized springback 54 have been greatly reduced, leaving the contour of the formed workpiece 12 much closer to the desired IML 10A of the component shown in FIG. 10.

Figure 14:
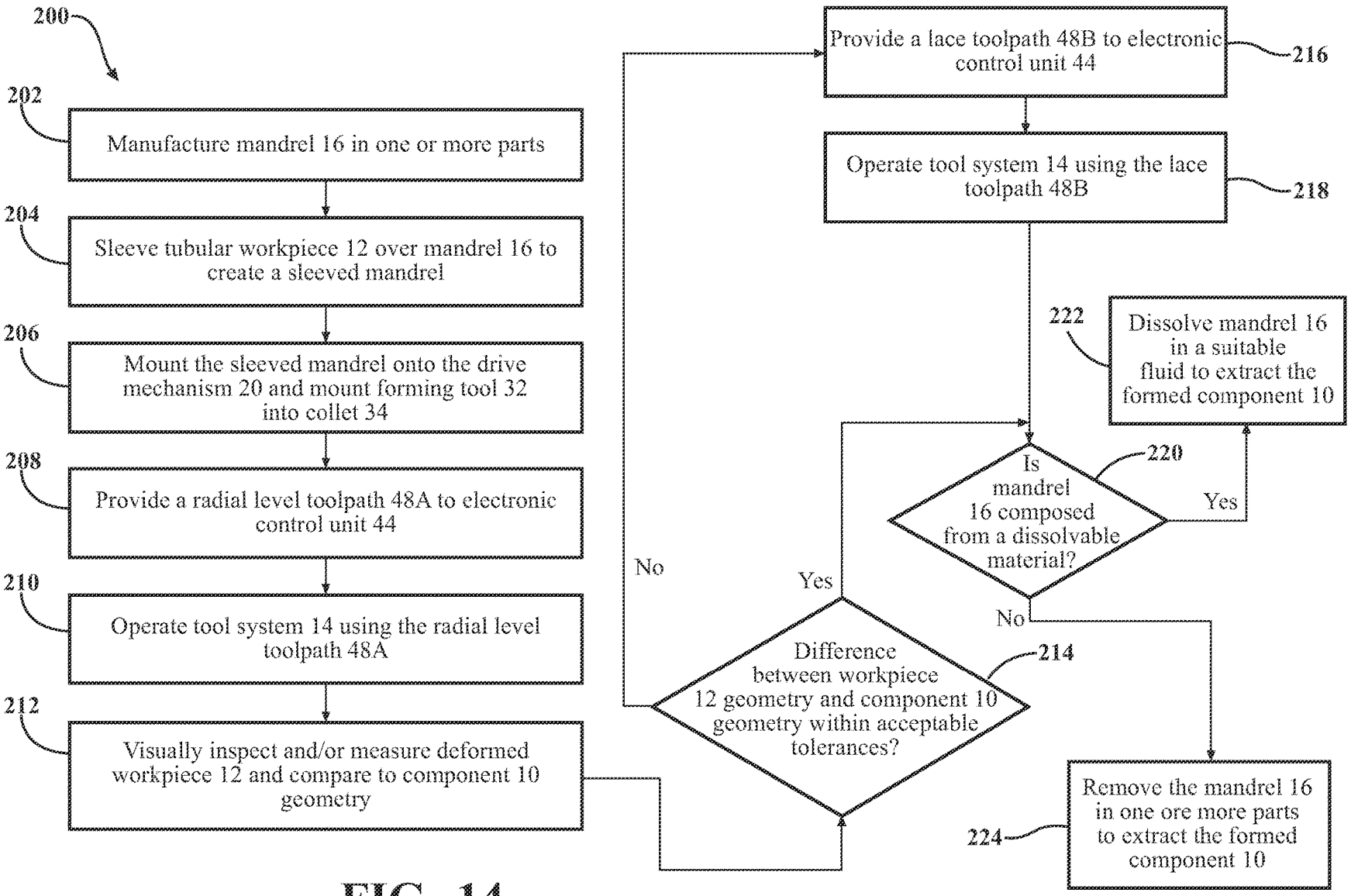
FIG. 14 is a flow chart illustrating a method of radial incremental forming of a component from a tubular workpiece, for example employing the tool system shown in FIGS. 1-9.

FIG. 14 depicts a method 200 of radial incremental forming a component, such as the component 10 having the IML 10A, and employing the tool system 14, as described above with respect to FIGS. 1-13. The method 200 is particularly adapted to generate a component IML 10A which has a non-axisymmetric shape, as shown in FIG. 2 and FIG. 10. The method 200 commences in Block 202, where it includes providing the mandrel 16. The mandrel 16 may be fashioned by using additive manufacturing or alternatively from lathing, machining, or otherwise generated from a bar stock of suitable material to produce one or more components that collectively comprise the subject mandrel. The mandrel 16 has a surface geometry which mates with the IML 10A of the component 10. As disclosed above, the mandrel 16 may be constructed from dissolvable material 52, such as shown in FIG. 3A or from multiple individual sections, such as sections 16-1, 16-2, 16-3, 16-4 shown in in FIG. 3B. Following Block 202, the method proceeds to Block 204. In Block 204, the method 200 includes inserting the mandrel 16 into the tubular workpiece 12, to thereby sleeve the workpiece over the mandrel 16. Examples of the sleeved tubular workpiece 12 and mandrel 16 are shown in a cutaway style in FIGS. 4A and 4B. After Block 204, the method 200 advances to Block 206. In Block 206, the method 200 includes mounting the workpiece 12 sleeved over the mandrel 16 onto the drive mechanism 20 and mounting the forming tool 32 into the collet 34. In Block 206, the method may further include applying a suitable lubricant to the outer mold line (OML) of the workpiece 12.

Following mounting the workpiece 12 sleeved over the mandrel 16, the method 200 proceeds to Block 208. In Block 208, the method 200 includes supplying the radial level toolpath 48A to the electronic controller 44, such as in the form of G-code or Aptsource instructions provided via an ASCII text file. The method 200 then advances to Block 210, where the toolpath is used to regulate operation of the drive mechanism 20. Specifically, the toolpath is read by the electronic control unit 44 of the tool system 14, which commands, via regulation of the corresponding servomechanism, angular movement between discrete rotational positions of the spindle 22 driving the sleeved mandrel 16 in concert with commanding translation, i.e., the magnitudes of shift, of the forming tool 32 via regulation of the respective servomechanism driving the lathe turret assembly 38. As described above, the commanded respective translations, i.e., the magnitudes of shift, of the forming tool 32 and the attendant rotational positions of the spindle 22 drive mechanism 20 are in accordance with the angular, axial, and radial coordinates and corresponding time values given in the radial level toolpath 48A.

Following execution of the radial level toolpath 48A by the tool system 14, the method 200 then proceeds to Block 212 where the deformed workpiece 12 is inspected to determine the difference between the deformed geometry of the workpiece 12 and the requisite geometry of the component 10. The subject difference is then assessed in Block 214 to determine if the deformed workpiece 12 is within the specified component tolerances. This inspection step may be informal and qualitative, such as using visual judgment to determine if springback has caused the deformed workpiece to exceed the specified tolerances or, alternatively, the process may include formal and quantitative approaches such as metrology. For example, this step may include laser scanning the deformed workpiece 12 to generate a point cloud data set, registering this point cloud such that it is in alignment with the component 10 geometry and then computing the minimum distance between each point and the component 10 geometry. Such calculations may then be used to generate a map of deviation of the workpiece 12 geometry from the component 10 geometry for the purposes of assessing if the workpiece geometry matches the component geometry to within the required tolerances.

Depending on the outcome at Block 214, the method 200 then proceeds to either Block 216 or Block 220. In the event the formed component 10 does not meet the specified tolerances, the method 200 proceeds to Block 216. In Block 216 the method 200 includes supplying the lace toolpath 48B to the electronic controller 44, such as in the form of G-code or Aptsource instructions given via an ASCII text file. The method 200 then advances to Block 218, where the lace toolpath 48B is used to operate the drive mechanism 20. Specifically, the lace toolpath 48B is read by the electronic controller 44 of the tool system 14, which commands, via regulation of the rotational movement of the spindle 22 driving the sleeved mandrel 16 in concert with commanding translation of the forming tool 32. The commanded rotations and translations are in accordance with the coordinates and corresponding times given in the lace toolpath 48B. Accordingly, over the course of Blocks 210-218, the method 200 includes applying to the tubular workpiece 12, via the forming tool 32, the radial level toolpath 48A followed by the lace toolpath 48B to thereby minimize localized springback of the tubular workpiece and achieve the desired component IML 10A. The method 200 then continues to Block 220. In the event the formed workpiece 12 does meet the specified tolerances at Block 214, the method 200 proceeds directly from Block 212 to Block 220.

Following Block 220, the method 200 proceeds to either Block 222 or Block 224, depending on which type of mandrel 16 has been used. If the mandrel 16 is composed of a dissolvable material, such as Aquacore™, the method 200 proceeds to Block 222. In Block 222, the sleeved mandrel 16 is soaked in a suitable fluid for a predetermined amount of time to extract the deformed workpiece 12. Alternatively, if the mandrel 16 is constructed from one or more parts which are made of a non-dissolvable material, such as the sections 16-1 to 16-4, the method 200 proceeds to Block 224. In Block 224, the mandrel 16 is separated from workpiece 12. Where required, this step may include disassembly of the mandrel sections in a particular order. For example, with reference to FIG. 3B, sections 16-3 and 16-4 may be removed from the mandrel assembly first. Once the end parts of the mandrel assembly (i.e., sections 16-3 and 16-4) have been removed, sections 16-1 and 16-2 will have additional space to move toward axis 15, and therefore be free to separate from the component 10 (i.e., the formed workpiece 12) in an unstructured fashion.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

What is claimed is:

1. A method of radial incremental forming a component having a component inner mold line (IML), the method comprising:

providing a mandrel having a mandrel geometry configured to mate with the IML;

inserting the mandrel along an axis into a tubular workpiece composed from a formable material, to thereby sleeve the tubular workpiece over the mandrel;

mounting the tubular workpiece sleeved over the mandrel onto a drive mechanism, wherein the drive mechanism is configured to rotate the mandrel about the axis and includes a stylus configured to shift relative to the tubular workpiece and thereby apply a forming force to the tubular workpiece;

providing toolpath instructions configured to regulate the drive mechanism; and regulating, according to the toolpath instructions, the drive mechanism to rotate the tubular workpiece sleeved over the mandrel in concert with shifting the stylus relative to the tubular workpiece to incrementally deform the tubular workpiece therewith over the mandrel and thereby form the component.

2. The method of radial incremental forming of claim 1, wherein providing the mandrel includes constructing the mandrel from multiple individual sections, the method further comprising removing the multiple individual sections of the mandrel from the formed component without disturbing the component IML.

3. The method of radial incremental forming of claim 2, wherein providing the mandrel further includes constructing the mandrel from a polymer, timber, fiber board, metal, fiberglass, and/or carbon reinforced plastic (CFRP).

4. The method of radial incremental forming of claim 1, wherein providing the mandrel includes constructing the mandrel from a material configured to be dissolved in a fluid, the method further comprising dissolving the mandrel to remove the mandrel from the formed component without disturbing the component IML.

5. The method of radial incremental forming of claim 1, wherein the toolpath instructions include a radial level toolpath and a lace toolpath, the method further comprising applying to the tubular workpiece, via the stylus, the radial level toolpath followed by the lace toolpath to thereby minimize localized springback of the tubular workpiece and achieve a desired component IML.

6. The method of radial incremental forming of claim 1, wherein shifting the stylus is accomplished in a radial and/or axial direction relative to the tubular workpiece in concert with a rotation of the mandrel.

7. The method of radial incremental forming of claim 1, wherein:

the drive mechanism is a multi-axis drive mechanism controlled via an electronic controller programmed with the toolpath instructions;

the toolpath instructions include sets of coordinates; and each set of coordinates identifies a mandrel rotation, an axial shift of the stylus, and a radial shift of the stylus at a predetermined time relative to commencement of the forming of the component;

the method further comprising regulating the drive mechanism, via the electronic controller, to form the component.

8. The method of radial incremental forming of claim 7, wherein providing the toolpath instructions includes:

providing a digital definition of a surface geometry of the component IML;

generating a tool offset surface geometry based on the surface geometry of the component IML;

transforming, via inverse cylindrical mapping, the tool offset surface geometry from a first topological space into a second topological space;

intersecting the tool offset surface geometry in the second topological space with a plurality of parallel planes defined in the second topological space, to thereby obtain a plurality of toolpath contours connected to form a toolpath in the second topological space;

transforming, via cylindrical mapping, the toolpath from the second topological space to the first topological space; and selecting a plurality of points spaced along the toolpath, wherein each of the plurality of points is defined by one of the sets of coordinates, and wherein each mandrel rotation, axial shift of the stylus, and radial shift of the stylus is identified relative to a predefined reference point on the stylus.

9. A tool system for radial incremental forming a component having a component inner mold line (IML), the system comprising:

a mandrel having a mandrel geometry configured to mate with the IML and configured to be inserted along an axis into a tubular workpiece composed from a formable material, to thereby sleeve the tubular workpiece over the mandrel;

a drive mechanism configured to rotate the mandrel about the axis and including a stylus configured to shift relative to the tubular workpiece and thereby apply a forming force to the tubular workpiece; and an electronic controller programmed with toolpath instructions configured to regulate the drive mechanism to rotate the tubular workpiece sleeved over the mandrel in concert with shifting the stylus relative to the tubular workpiece to incrementally deform the tubular workpiece therewith over the mandrel and thereby form the component.

10. The tool system of claim 9, wherein the mandrel is constructed from multiple individual sections configured to be removed from the formed component without disturbing the component IML.

11. The tool system of claim 10, wherein the mandrel is constructed from a polymer, timber, fiber board, metal, fiberglass, and/or carbon reinforced plastic (CFRP).

12. The tool system of claim 9, wherein the mandrel is constructed from a material configured to be dissolved in a fluid to thereby be removed from the formed component without disturbing the component IML.

13. The tool system of claim 9, wherein the toolpath instructions include a radial level toolpath and a lace toolpath, and wherein the toolpath instructions are further configured to apply to the tubular workpiece, via the stylus, the radial level toolpath followed by the lace toolpath to thereby minimize localized springback of the tubular workpiece and achieve a desired component IML.

14. The tool system of claim 9, wherein the toolpath instructions are configured to shift the stylus in a radial and/or axial direction relative to the tubular workpiece in concert with a rotation of the mandrel.

15. The tool system of claim 9, wherein:

the drive mechanism is a multi-axis drive mechanism;

the toolpath instructions include sets of coordinates; and each set of coordinates identifies a mandrel rotation, an axial shift of the stylus, and a radial shift of the stylus at a predetermined time relative to commencement of the forming of the component.

16. A method of radial incremental forming a component having a component inner mold line (IML), the method comprising:

providing a mandrel having a mandrel geometry configured to mate with the IML;

inserting the mandrel along an axis into a tubular workpiece composed from a formable material, to thereby sleeve the tubular workpiece over the mandrel;

mounting the tubular workpiece sleeved over the mandrel onto a multi-axis drive mechanism controlled via an electronic controller, wherein:

the multi-axis drive mechanism is configured to rotate the mandrel about the axis and includes a forming tool configured to shift relative to the tubular workpiece and thereby apply a forming force to the tubular workpiece;

the electronic controller is programmed with toolpath instructions providing sets of coordinates; and each set of coordinates identifies a mandrel rotation, an axial shift of the forming tool, and a radial shift of the forming tool at a predetermined time relative to commencement of the forming of the component; and regulating, via the electronic controller according to the toolpath instructions, the drive mechanism to rotate the tubular workpiece sleeved over the mandrel in concert with shifting the forming tool relative to the tubular workpiece to incrementally deform the tubular workpiece therewith over the mandrel and thereby form the component.

17. The method of radial incremental forming of claim 16, wherein providing the mandrel includes constructing the mandrel from multiple individual sections, the method further comprising removing the multiple individual sections of the mandrel from the formed component without disturbing the component IML.

18. The method of radial incremental forming of claim 16, wherein providing the mandrel includes constructing the mandrel from a material configured to be dissolved in a fluid, the method further comprising dissolving the mandrel to remove the mandrel from the formed component without disturbing the component IML.

19. The method of radial incremental forming of claim 16, wherein shifting the forming tool is accomplished in a radial and/or axial direction relative to the tubular workpiece in concert with a rotation of the mandrel.

20. The method of radial incremental forming of claim 16, further comprising providing the toolpath instructions, including:

providing a digital definition of a surface geometry of the component IML;

generating a tool offset surface geometry based on the surface geometry of the component IML;

transforming, via inverse cylindrical mapping, the tool offset surface geometry from a first topological space into a second topological space;

intersecting the tool offset surface geometry in the second topological space with a plurality of parallel planes defined in the second topological space, to thereby obtain a plurality of toolpath contours connected to form a toolpath in the second topological space;

transforming, via cylindrical mapping, the toolpath from the second topological space to the first topological space; and selecting a plurality of points spaced along the toolpath, wherein each of the points is defined by one of the sets of coordinates, and wherein each mandrel rotation, axial shift of the forming tool, and radial shift of the forming tool is identified relative to a predefined reference point on the forming tool.

* * * * *